US012256775B2

(12) United States Patent
Huang

(10) Patent No.: US 12,256,775 B2
(45) Date of Patent: Mar. 25, 2025

(54) MODULAR VAPORIZING DEVICE AND SYSTEM

(71) Applicant: Cloudious9 Inc., Freemont, CA (US)

(72) Inventor: Richard Yao Tien Huang, Freemont, CA (US)

( * ) Notice: Subject to any disclaimer, the term of this patent is extended or adjusted under 35 U.S.C. 154(b) by 1017 days.

(21) Appl. No.: 17/113,649

(22) Filed: Dec. 7, 2020

(65) Prior Publication Data

US 2021/0084967 A1 Mar. 25, 2021

Related U.S. Application Data

(63) Continuation-in-part of application No. 15/592,452, filed on May 11, 2017, now Pat. No. 10,856,568, which is a continuation-in-part of application No. 15/040,622, filed on Feb. 10, 2016, now abandoned.

(51) Int. Cl.

| | |
|---|---|
| ***A24F 40/20*** | (2020.01) |
| ***A24F 1/08*** | (2006.01) |
| ***A24F 1/16*** | (2006.01) |
| ***A24F 40/57*** | (2020.01) |
| *A24F 40/10* | (2020.01) |
| *A24F 40/46* | (2020.01) |
| *A24F 40/485* | (2020.01) |

(52) U.S. Cl.

CPC ..... *A24F 1/08* (2013.01); *A24F 1/16* (2013.01); *A24F 40/57* (2020.01); *A24F 40/10* (2020.01); *A24F 40/20* (2020.01); *A24F 40/46* (2020.01); *A24F 40/485* (2020.01)

(58) Field of Classification Search

None

See application file for complete search history.

(56) References Cited

U.S. PATENT DOCUMENTS

| | | | | |
|---|---|---|---|---|
| 3,889,690 | A * | 6/1975 | Guarnieri | A24F 1/30 131/330 |
| 2010/0275937 | A1* | 11/2010 | Shakouri Moghadam | A24F 1/30 131/196 |
| 2016/0353799 | A1* | 12/2016 | Otto | A24F 40/46 |
| 2016/0353800 | A1* | 12/2016 | Di Carlo | A24F 40/30 |
| 2017/0027224 | A1* | 2/2017 | Volodarsky | H05B 3/0014 |
| 2017/0119057 | A1* | 5/2017 | Liu | F21V 19/004 |
| 2018/0317544 | A1* | 11/2018 | Hagen | A24F 1/30 |

* cited by examiner

*Primary Examiner* — Katherine A Will

(74) *Attorney, Agent, or Firm* — Olav M. Underdal; IDP Patent Services

(57) ABSTRACT

A vaping device including a water chamber for filtering smoke or vapor prior to inhalation of the smoke or vapor. The device including a replaceable vaporization module with a vaporization chamber that contains a substance to be heated or burned. The device including an air flow chamber, herein the air flow chamber connects the vaporization chamber, wherein the air flow chamber is configured to provide a tunnel between an upper edge and a lower edge of the air flow chamber, for passage of air/vapor from an air/vapor entry port to a filtered air exit port for air/vapor at the water chamber, in a snake like manner; wherein the air/vapor entry port is located at a point where the vaporization chamber is joined to the water chamber. Also disclosed is a vaping system, including a device body and a plurality of interchangeable vaporization modules.

18 Claims, 17 Drawing Sheets

Vaping System

Vaping Device

MODULAR VAPORIZING DEVICE AND SYSTEM

CROSS-REFERENCE TO RELATED APPLICATIONS

This application is a Continuation-In-Part of U.S. Non-Provisional application Ser. No. 15/592,452, filed May 11, 2017, which is a Continuation-In-Part of U.S. Provisional application Ser. No. 15/040,622, filed Feb. 10, 2016; both of which are hereby incorporated herein by reference in their entirety.

FIELD OF THE INVENTION

The present invention relates generally to the field of inhalation devices, and more particularly to methods and systems for inhalation devices comprising enhanced means for heat distribution, air flow for direct burn, vaporization of material in the inhalation device, and for leak prevention.

BACKGROUND OF THE INVENTION

Currently there are many types of inhalation devices available for the vaporization and direct burning of herbs and other substances such as, but not limited to, wax and oil. A main difference between vaporizing and direct burning is that is during vaporization, the heating temperature is typically lower than in direct burning and usually the heated air travels through the substance being vaporize to melt the active ingredients. During vaporization, the heat source typically does not touch the substance, and if the heat source does touch the substance, the temperature of the heat source is usually not hot enough to enable combustion to occur. In a direct burning or smoking device, the heat source may directly touch the substance, and combustion often occurs. Current vaporizers and direct burning devices typically require the herbs to be grinded to a very fine state to allow for proper exposure to heat. It is believed that even when the herbs are grinded properly uneven heat distribution may occur due to a variety of factor such as, but not limited to, how the herbs were packed, the volume of herbs used, the shape of the burning surface, etc. These vaporizers and direct burning devices usually heat from the bottom, which may mean that only the lower layers of the herbs may be vaporized or burned.

By way of educational background, another aspect of the prior art generally useful to be aware of is that current vaporization or direct burn may often leave the vaporized or burned air very dry and hot, which may be unsuitable for prolong usage and may result in higher quantity of undesirable substance to be inhaled. Water filtration has been one of the oldest forms of the filtration system used during smoking to resolve both issues. It filters out the undesirable substances and cools and moisturizes the air that is being inhaled. Current solution for vaporization typically may include an add on mouthpiece that is filled with water to be attached to vaporizers and direct burning device. Such devices, especially in an electronic vaporizer setting may provide 1) a separate attachment, which requires separate protection during carrying, 2) may only be used after the separate attachments are assembled and each time has to be disassembled and 3) the assembled device with both water filtration and vaporizer may not be carriable, e.g., the user carrying it risks spilling out the water so typically dumps out the water after each use, then refills to setup again for later use.

As such, considering the foregoing, it may be appreciated that there continues to be a need for novel and improved devices and methods for vaping devices.

SUMMARY OF THE INVENTION

The foregoing needs are met, to a great extent, by the present invention, wherein in aspects of this invention, enhancements are provided to the existing model of vaping devices.

In an aspect, a vaping device can include:

a) a device body; and b) a vaporization module, which comprises:

a module body, which comprises an upper opening and a vaporization chamber, such that the upper opening provides access to the vaporization chamber;

wherein the vaporization chamber is configured to be operable for containing a substance for vaporization;

wherein the vaporization module is configured to be detachably mountable to the device body.

In a related aspect, the device body can further include:

a) a protruding cavity, which protrudes horizontally into or through the device body;

such that the vaporization module is configured to be partially insertable into the protruding cavity, such that an inner portion of the vaporization module is inserted into the protruding cavity, and such that an outer portion of the vaporization module protrudes to a side of the device body, such that the upper opening to the vaporization chamber is exposed, such that the vaping device is in an active configuration for vaping use.

In another aspect, a vaping system can include:

a) a device body; and b) a plurality of vaporization modules, which each comprise:

i. a module body, which comprises an upper opening;

ii. and a vaporization chamber, such that the upper opening provides access to the vaporization chamber;

wherein the vaporization chamber is configured to be operable for containing a substance for vaporization;

wherein each vaporization module in the plurality of vaporization modules is configured to be detachably mountable to the device body.

In a related aspect, the plurality of vaporization modules can include:

a) an herb vaporization module, such that the vaporization chamber of the herb vaporization module is configured for heating an herb material; and b) an oil vaporization module, such that the vaporization chamber of the oil vaporization module is configured for vaporizing an oil or wax.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. In addition, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 1:
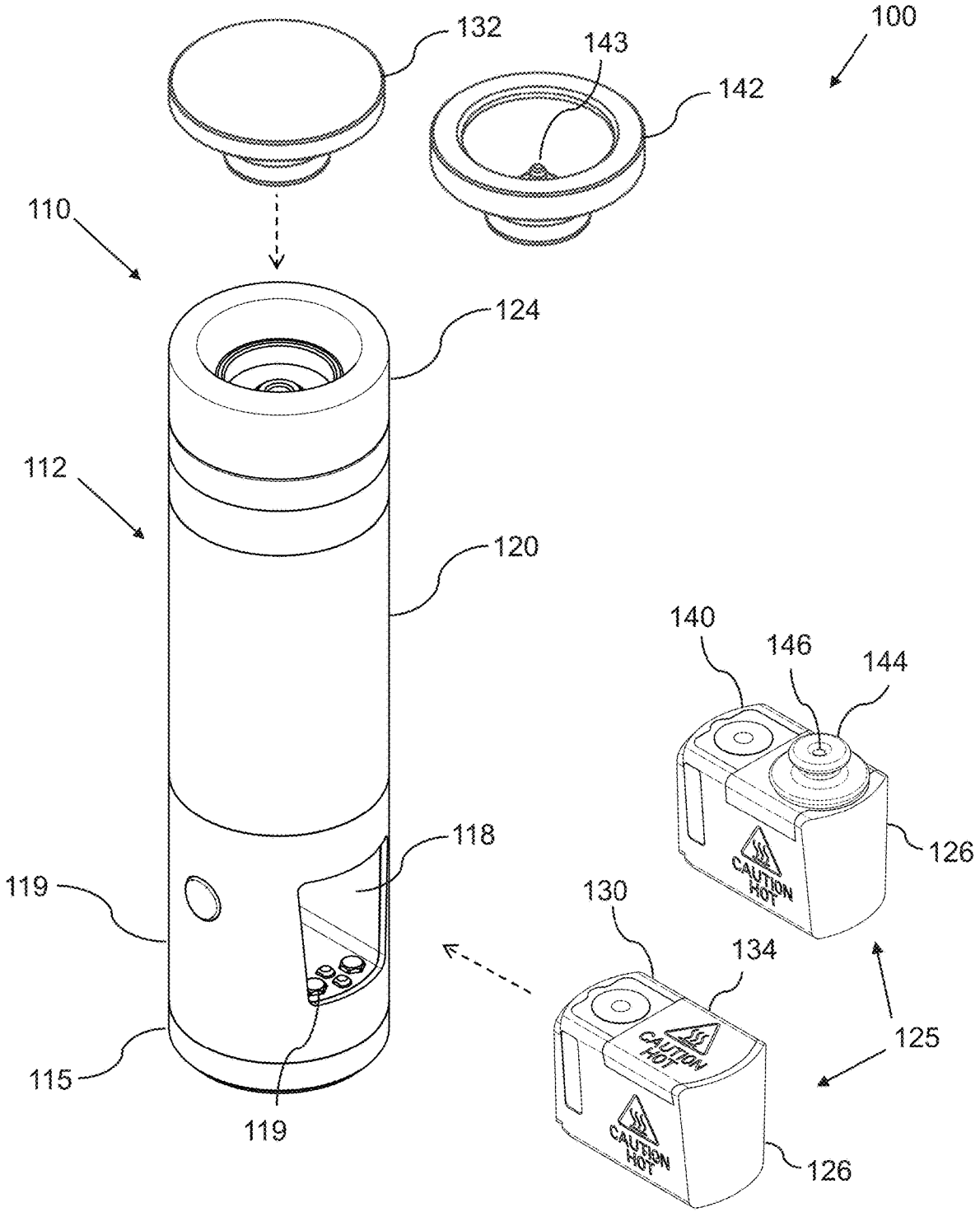
FIG. 1 is a perspective view of a vaping system, according to an embodiment of the invention.

Before describing the invention in detail, it should be observed that the present invention resides primarily in a novel and non-obvious combination of elements and process steps. So as not to obscure the disclosure with details that will readily be apparent to those skilled in the art, certain conventional elements and steps have been presented with lesser detail, while the drawings and specification describe in greater detail other elements and steps pertinent to understanding the invention.

The following embodiments are not intended to define limits as to the structure or method of the invention, but only to provide exemplary constructions. The embodiments are permissive rather than mandatory and illustrative rather than exhaustive.

In the following, we describe the structure of an embodiment of a vaping system 100 and a vaping device 110 with reference to FIG. 1, in such manner that like reference numerals refer to like components throughout; a convention that we shall employ for the remainder of this specification.

In an embodiment, as shown in FIG. 1, a modular vaping system 100 can include:

a) a modular vaping device body 112; and b) at least one vaporization module 125, which for example can be an herb vaporization module 130 or an oil vaporization module 140, wherein the at least one vaporization module 125 is configured to be detachably mountable to the vaping device body 112. Thus, the modular vaping system 100 can include a device body 112 and a plurality of interchangeable vaporization modules 125.

In a related embodiment, as shown in FIGS. 1, 2A, 2B and 4, a vaping system 100 can include:

a) a vaping device body 112; and b) an herb vaping assembly 230, which can include:

i. an herb vaping top cover 132, which can have a flat top surface, wherein the herb vaping top cover 132 is configured to cover a top of the vaping device body 112, when the vaping device 110 is not in use;

ii. an herb vaporization module 130, which is configured to be detachably mountable to the vaping device body 112;

c) an oil vaping assembly 240, which can include:

i. a carb cap 144, which can be configured to be positionable in the top opening of the vaporization chamber 422. The carb cap 144 can have a central protruding aperture 146, such that the carb cap 144 limits and control airflow to the vaporization chamber 422;

ii. an oil vaping top cover 142, which can be configured with a top receiving portion 143 for storing the carb cap 144, wherein the oil vaping top cover 142 is configured to cover a top of the vaping device body 112, when the vaping device 110 is not in use;

iii. an oil vaporization module 140, which is configured to be detachably mountable to the vaping device body 112.

Figure 5A:
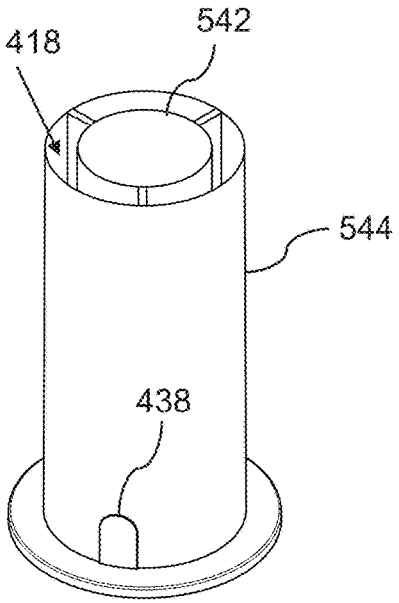
FIG. 5A is a top perspective view of an airflow chamber, according to an embodiment of the invention.
Figure 5B:
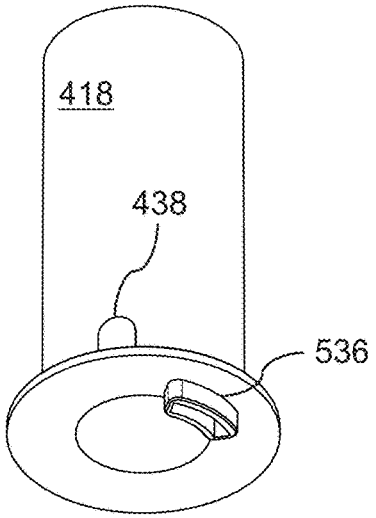
FIG. 5B is a bottom perspective view of an airflow chamber, according to an embodiment of the invention.
Figure 5C:
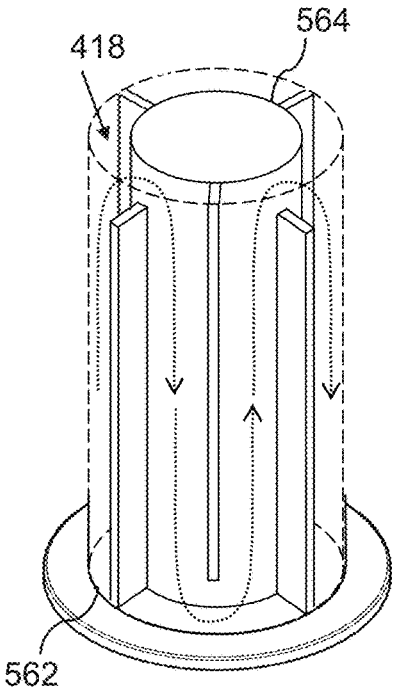
FIG. 5C is a top perspective view of an airflow chamber illustrating the airpath in an airflow chamber, according to an embodiment of the invention.
Figure 5D:
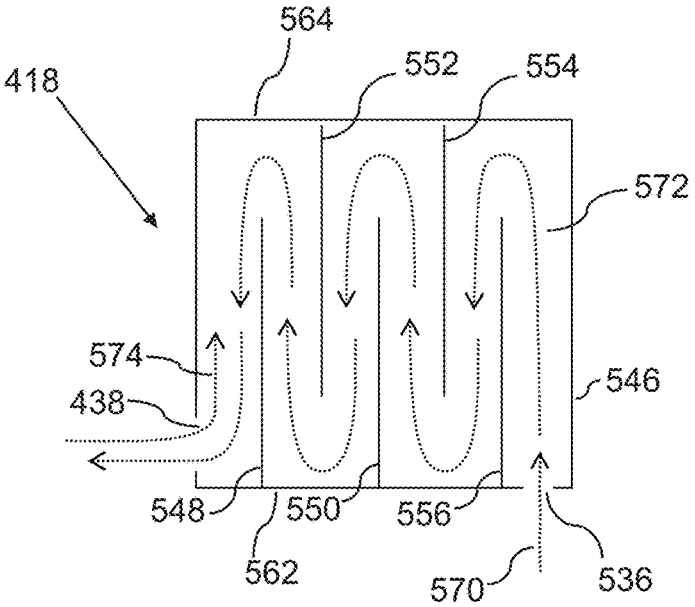
FIG. 5D is a schematic diagram illustrating the airpath in an airflow chamber, according to an embodiment of the invention.

In an embodiment, as shown in FIGS. 4, 5B, 5C, 5D, 16, and 17, a vaping device 110 can include:

a) a vaporization chamber 422, wherein the vaporization chamber 422 is configured to be substantially enclosed during operation and operable for containing a substance 1624, 1724 for vaporization; and b) a water chamber 120, wherein the water chamber 120 is connected to the vaporization chamber 422; and c) an air flow chamber 418, wherein the air flow chamber 418 connects the vaporization chamber 422, wherein the air flow chamber 418 is connected between the vaporization chamber 422 and the water chamber 120, wherein the air flow chamber 418 is configured to provide a tunnel between an upper edge 564 and a lower edge 562 of the air flow chamber 418, for passage of air/vapor 570 from an air/vapor entry port 536 to a filtered air exit port 438 for air/vapor at the water chamber 120, in a non-linear manner, as shown in FIGS. 5C and 5D; wherein the air/vapor entry port 536 is located at a point where the vaporization chamber 422 is joined to the water chamber 120;

wherein the air flow chamber 418 is configured to prevent leakage of water 482 from the water chamber 120 to the vaporization chamber 422. The air/vapor 570 can also be referred to as vapor 570.

In a related embodiment, as shown in FIGS. 1, 4, 11A, and 11B, the vaping device 110 can further include:

a) a mouthpiece 124 for inhaling smoke or vapor;

wherein the mouthpiece 124 is placed on the top of the vaping device body 112, wherein the mouthpiece 124 is configured to seal and connect the upper edge of the air flow chamber 418 to form an air flow passage 1118.

Figure 11A:
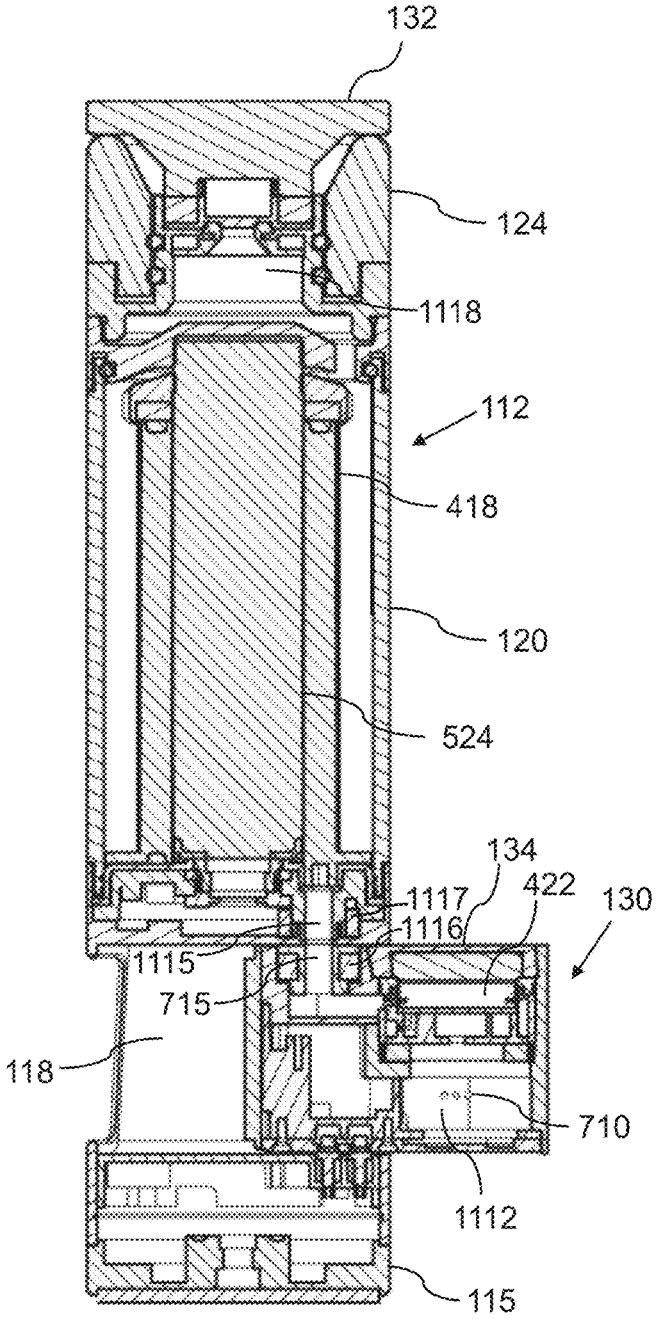
FIG. 11A is a front view of a section cut of a vaping system with an herb vaping assembly, according to an embodiment of the invention.
Figure 11B:
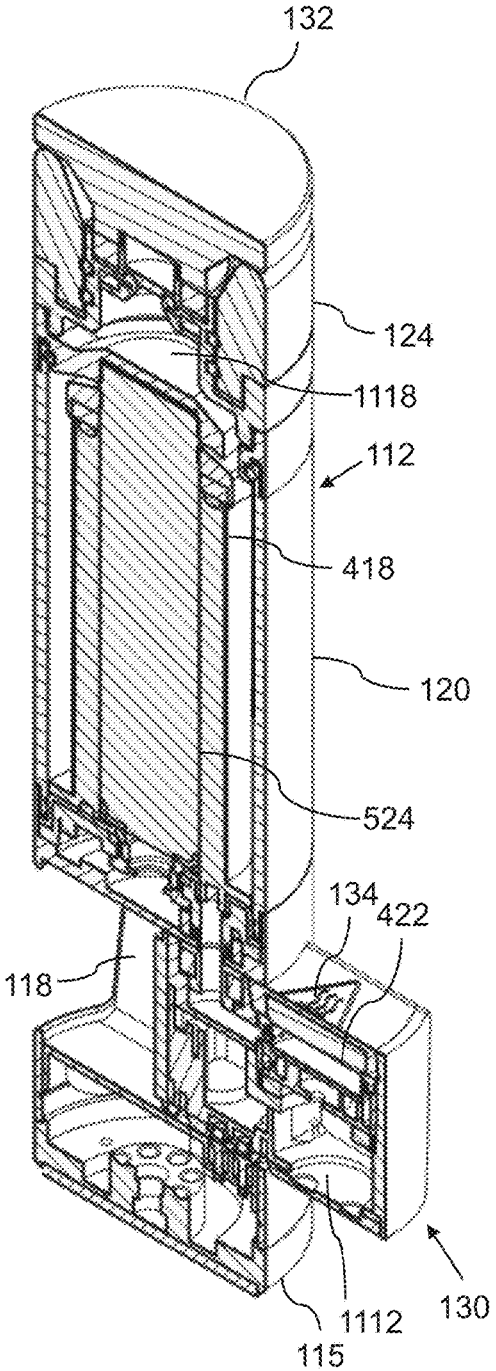
FIG. 11B is a top perspective view of a section cut of a vaping system with an herb vaping assembly, according to an embodiment of the invention.

In another related embodiment, as shown in FIGS. 11A and 11B, the vaping device 110 can further include:

a) a valve near the mouthpiece 124 to trap excess smoke or vapor in a sealed chamber/air flow passage 1118 above the vaporization chamber 422.

Figure 16:
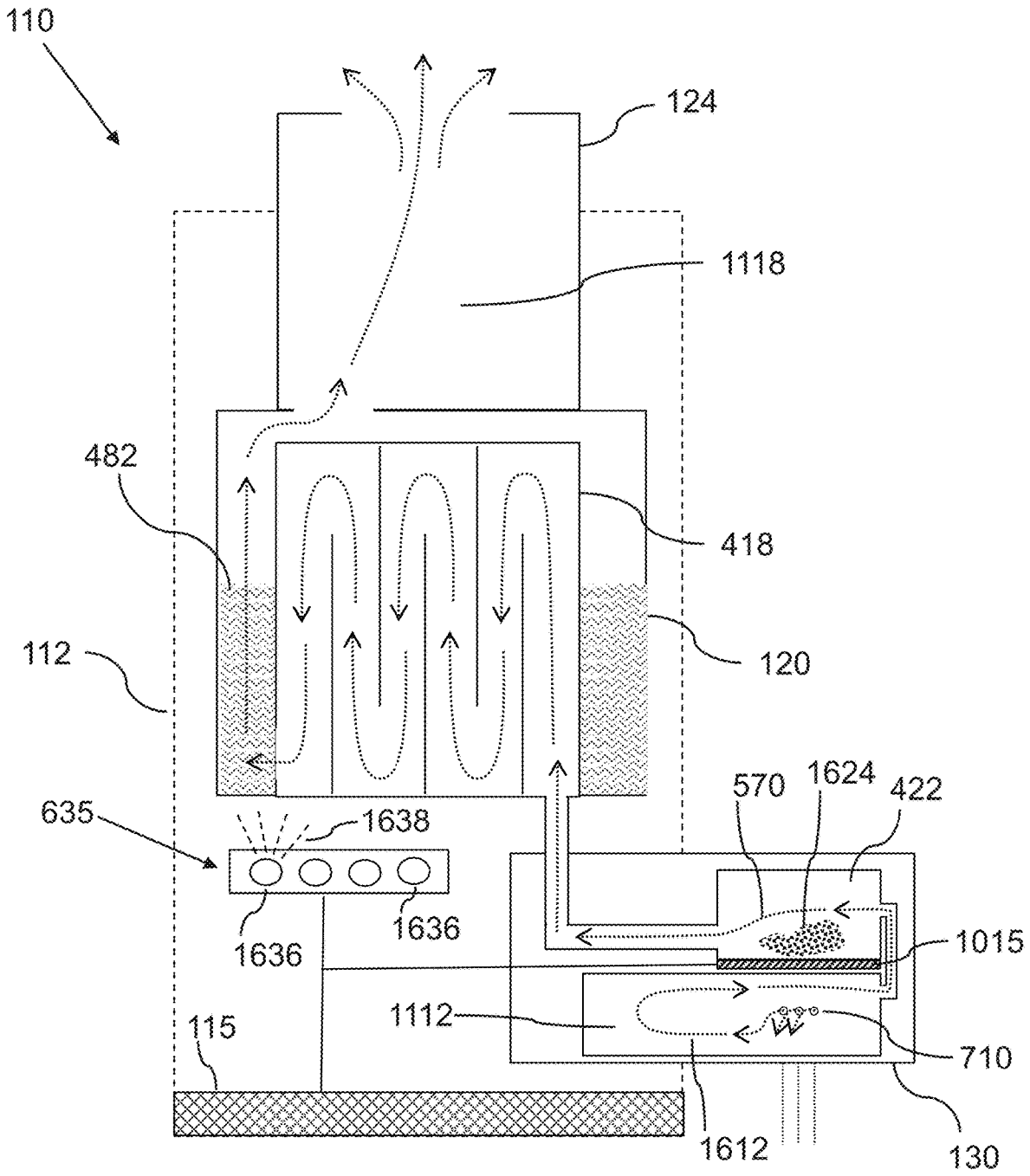
FIG. 16 is a schematic diagram illustrating the airpath of air/smoke/vapor in a vaping device with an herb vaporization module, according to an embodiment of the invention.
Figure 17:
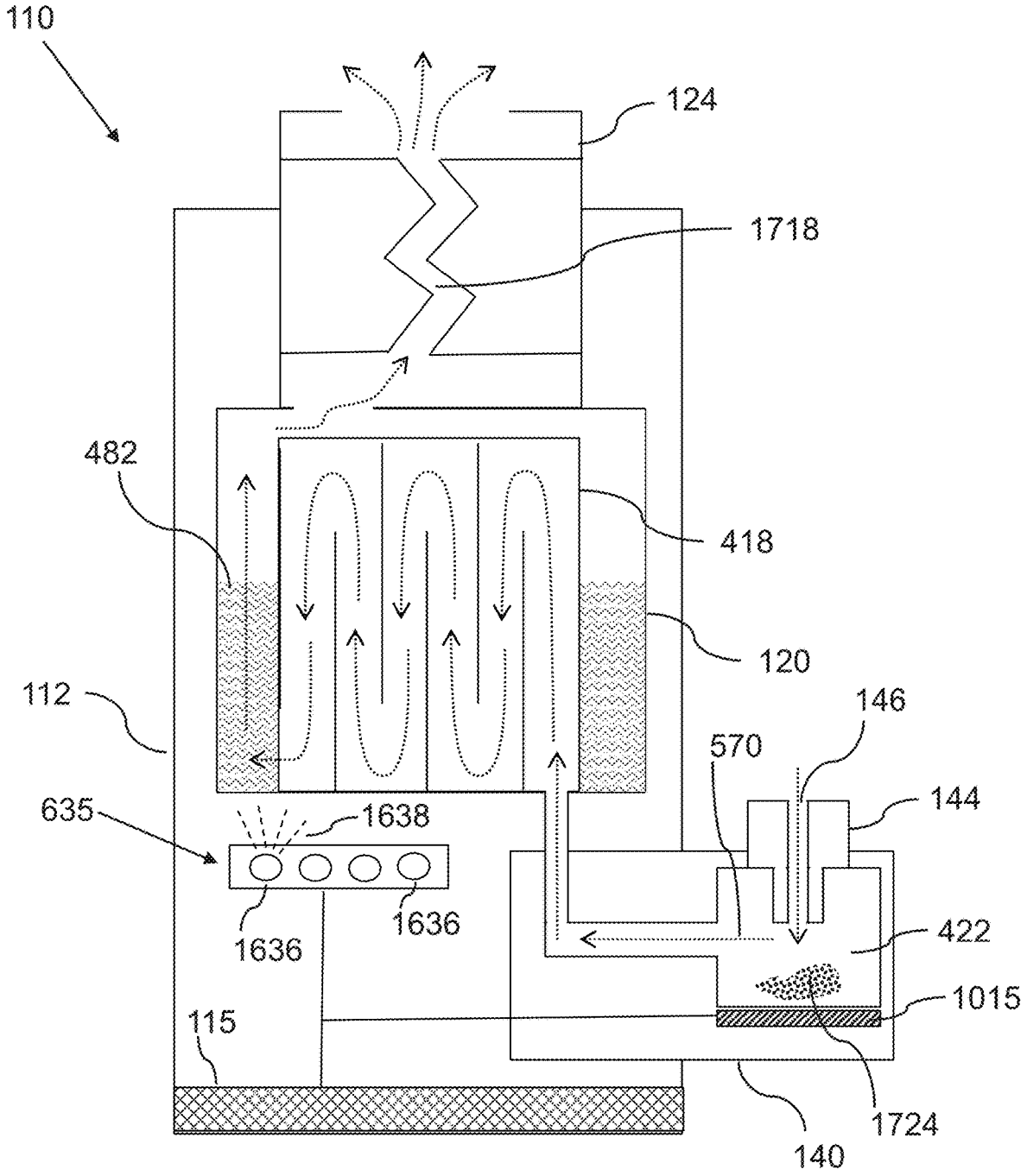
FIG. 17 is a schematic diagram illustrating the airpath of air/smoke/vapor in a vaping device with an oil vaporization module, according to an embodiment of the invention.

In yet another related embodiment, the air flow passage 1118, 1718 can include a straight (as shown in FIG. 16), spiral, zigzag (as shown in FIG. 17), or stepped configuration.

Figure 3A:
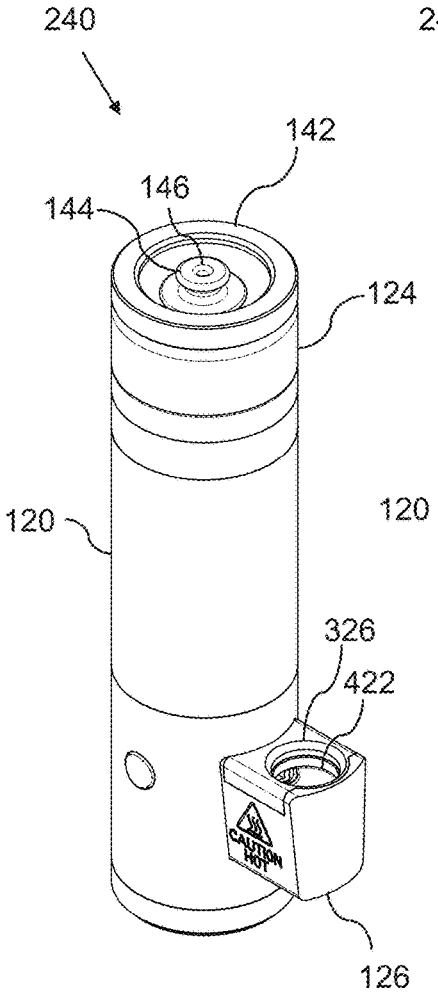
FIG. 3A is a top perspective view of an herb vaping assembly with a carb cap in an oil vaping top cover, according to an embodiment of the invention.
Figure 3B:
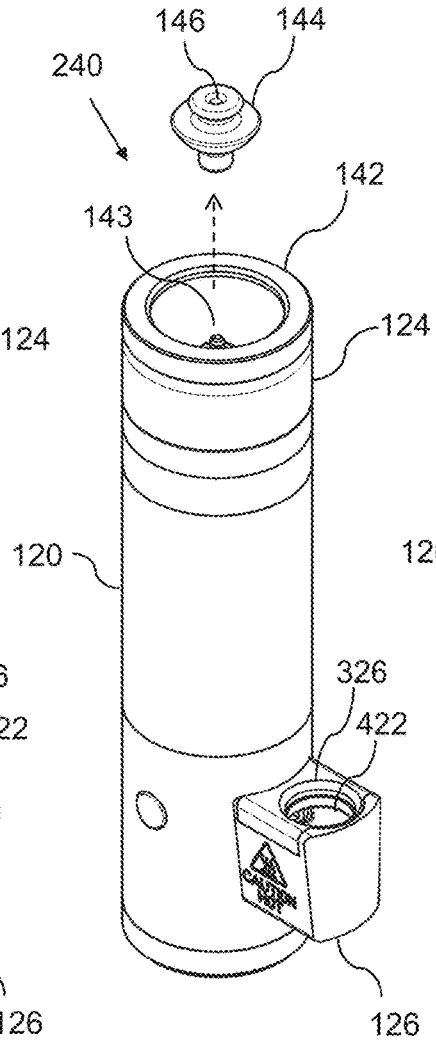
FIG. 3B is a top perspective view illustrating the removal of a carb cap from an oil vaping top cover, according to an embodiment of the invention.
Figure 3C:
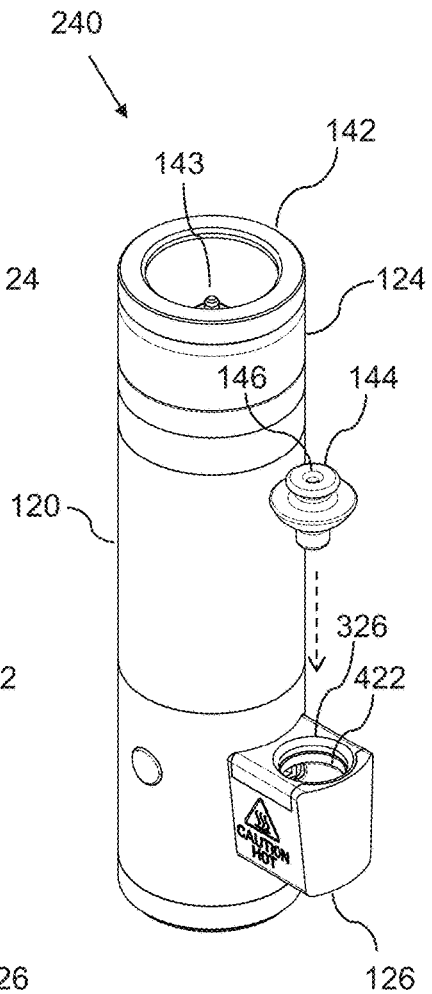
FIG. 3C is a top perspective view illustrating the insertion of a carb cap into an oil vaporization module, according to an embodiment of the invention.
Figure 4:
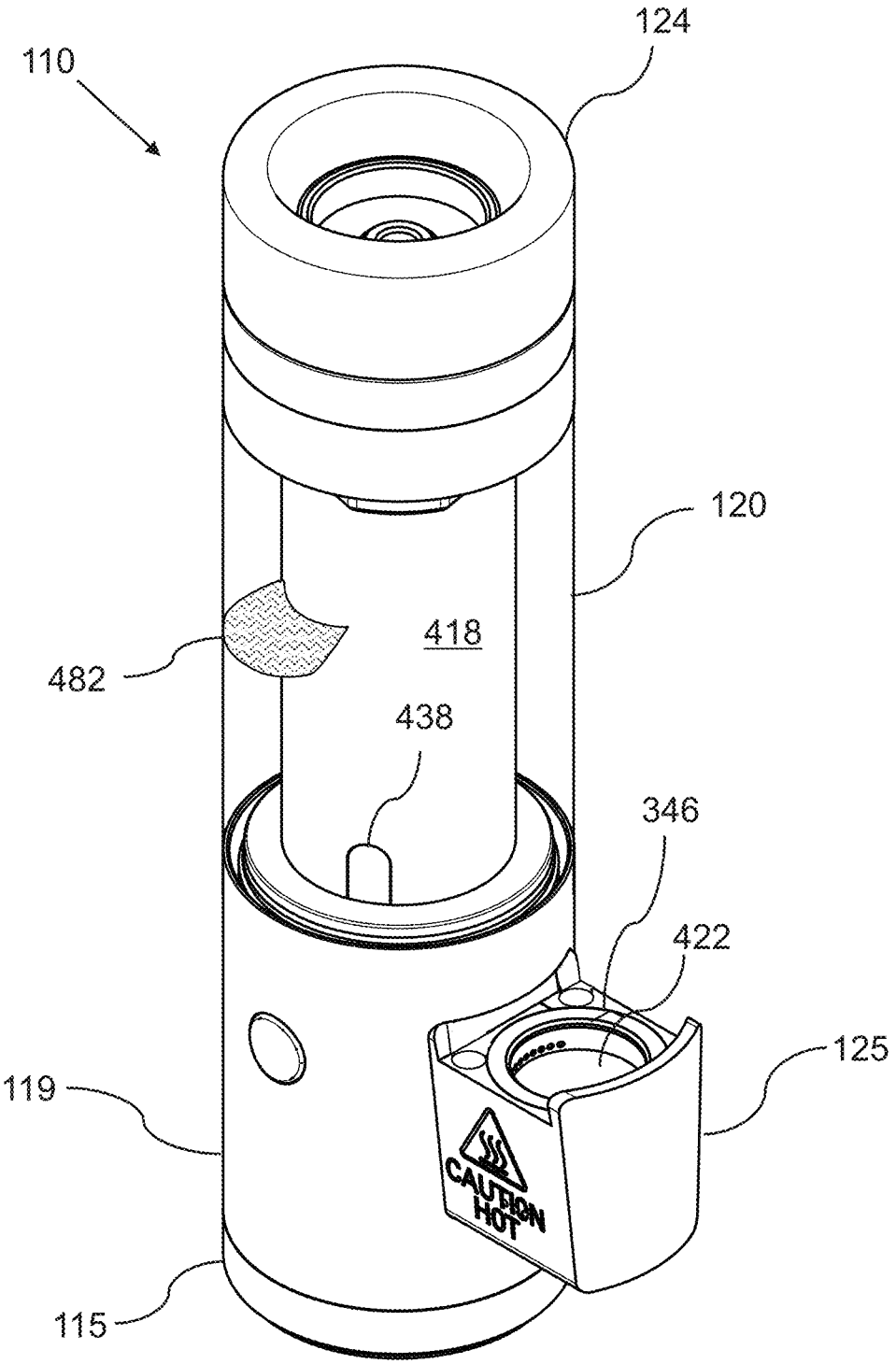
FIG. 4 is a top perspective view of a vaping device, according to an embodiment of the invention.

In another related embodiment, as shown in FIGS. 1, 3A, and 4, the vaping device 110 can further include:

a) a device body 112; and b) a vaporization module 125, which comprises:

a module body 126, which comprises an upper opening 326 and the vaporization chamber 422, such that the upper opening 326 provides access to the vaporization chamber 422;

wherein the vaporization module 125 is configured to be detachably mountable to the device body 112.

Figure 2A:
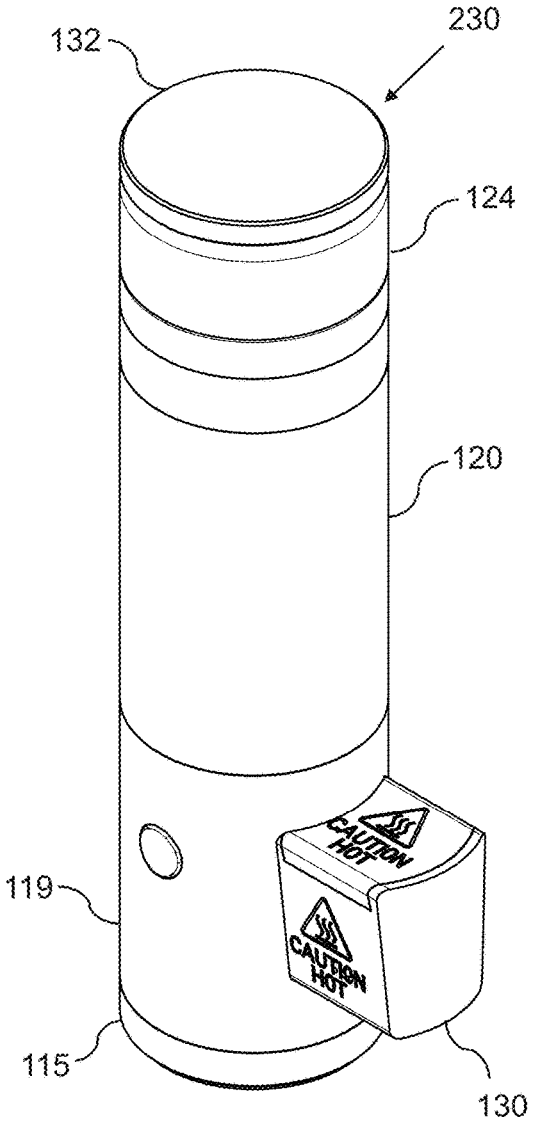
FIG. 2A is a top perspective view of a vaping device with an herb vaping assembly, which is partially inserted into a body of the vaping device in an active use configuration, according to an embodiment of the invention.
Figure 2B:
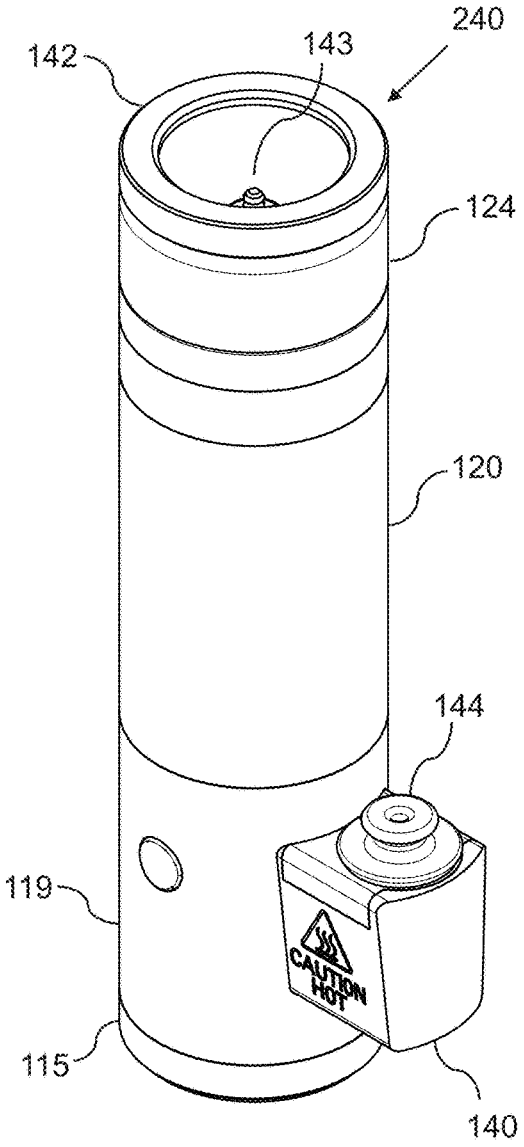
FIG. 2B is a top perspective view of a vaping device with an oil vaping assembly, which is partially inserted into a body of the vaping device in an active use configuration, according to an embodiment of the invention.
Figure 7A:
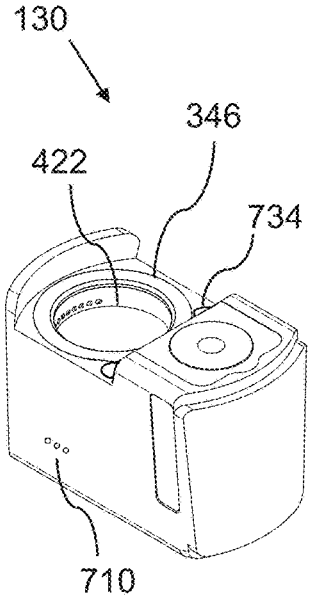
FIG. 7A is a rear perspective view of an open herb vaporization chamber, according to an embodiment of the invention.
Figure 7B:
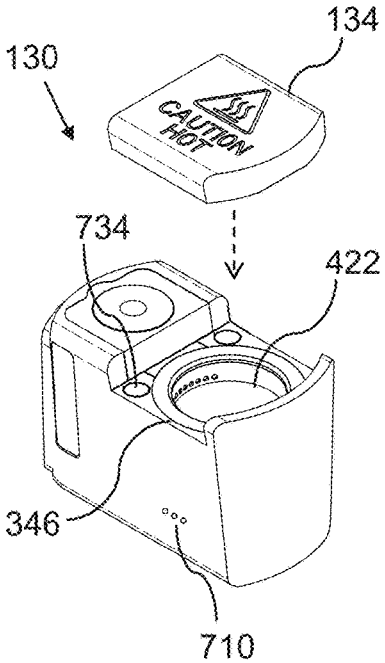
FIG. 7B is a front perspective view of an herb vaping top cover and an herb vaporization chamber, according to an embodiment of the invention.
Figure 7C:
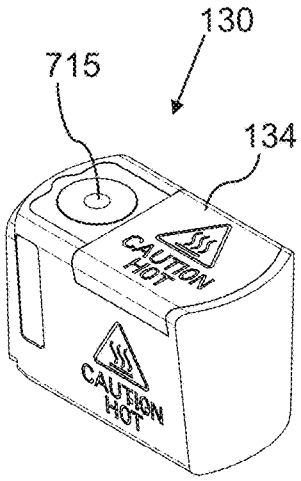
FIG. 7C is a front perspective view of a closed herb vaporization chamber, according to an embodiment of the invention.
Figure 8A:
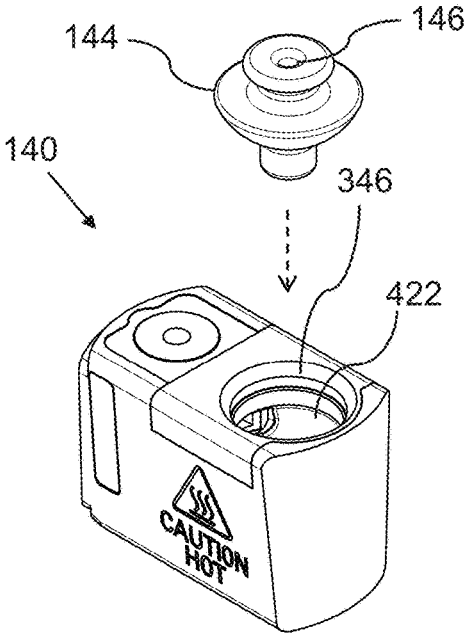
FIG. 8A is a perspective view illustrating the insertion of a carb cap into an open oil vaporization chamber, according to an embodiment of the invention.
Figure 8B:
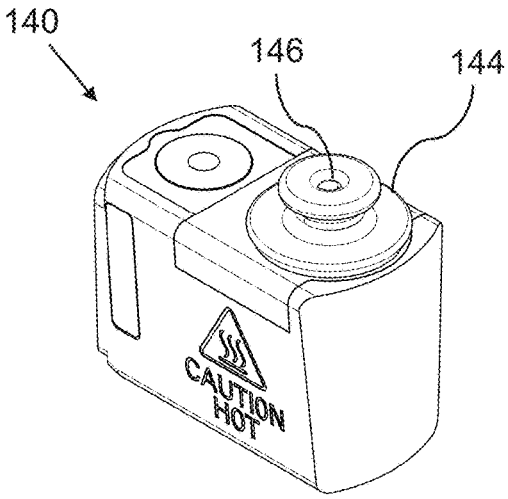
FIG. 8B is a perspective view of a carb cap and a closed oil vaporization chamber, according to an embodiment of the invention.

In a further related embodiment, as shown in FIGS. 1, 2A, and 2B, the device body 112 can further include:

a) a protruding cavity 118, which protrudes horizontally into the device body 112;

such that the vaporization module 125 is configured to be partially insertable into the protruding cavity 118, such that an inner portion of the vaporization module 125 is inserted into the protruding cavity 118, and such that an outer portion of the vaporization module 125 protrudes to a side of the device body 112, such that the upper opening 326 to the vaporization chamber 422 is exposed, such that the vaping device 110 is in an active configuration for vaping use, wherein a vapor exit aperture 715 of the vaporization module 125 is aligned with a vapor entry aperture 1115 of the device body 112, as shown in FIGS. 7C and 11A.

Figure 12A:
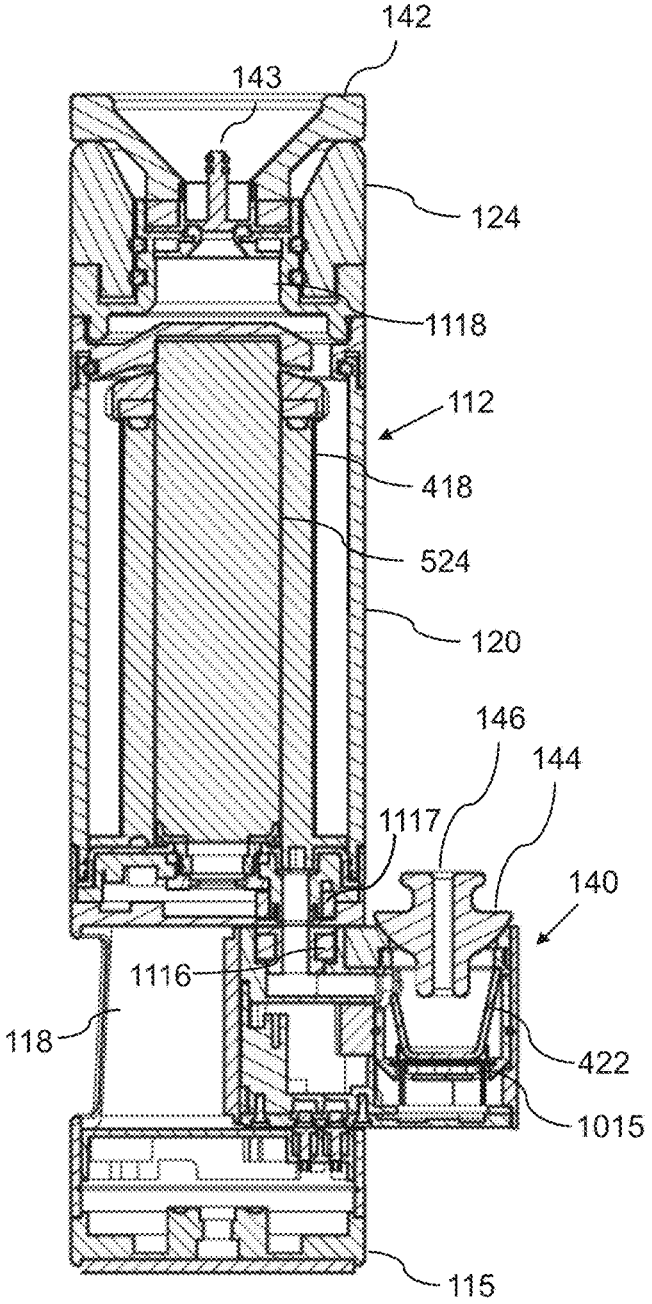
FIG. 12A is a front view of a section cut of a vaping system with an oil vaping assembly, according to an embodiment of the invention.
Figure 12B:
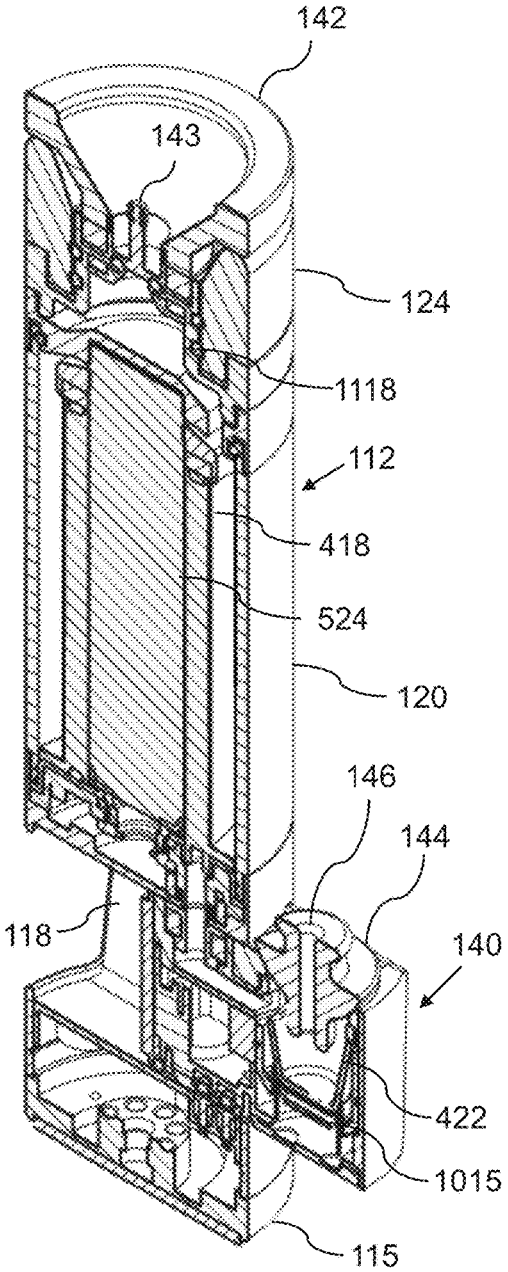
FIG. 12B is a top perspective view of a section cut of a vaping system with an oil vaping assembly, according to an embodiment of the invention.
Figure 13A:
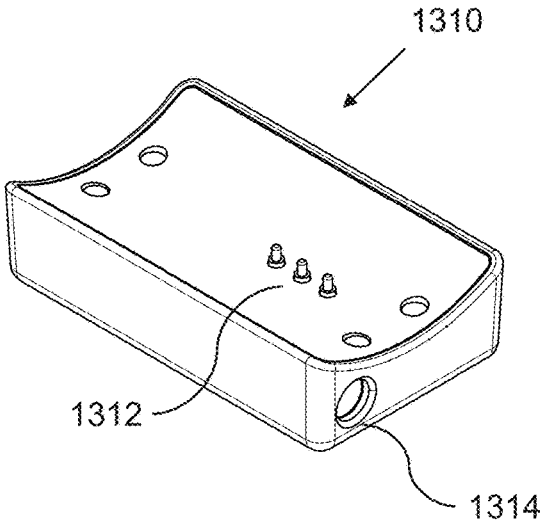
FIG. 13A is a top perspective view of a wireless charging module, according to an embodiment of the invention.
Figure 13B:
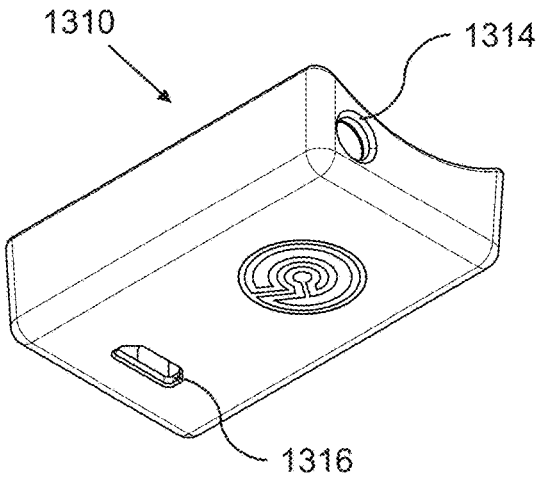
FIG. 13B is a bottom perspective view of a wireless charging module, according to an embodiment of the invention.
Figure 14:
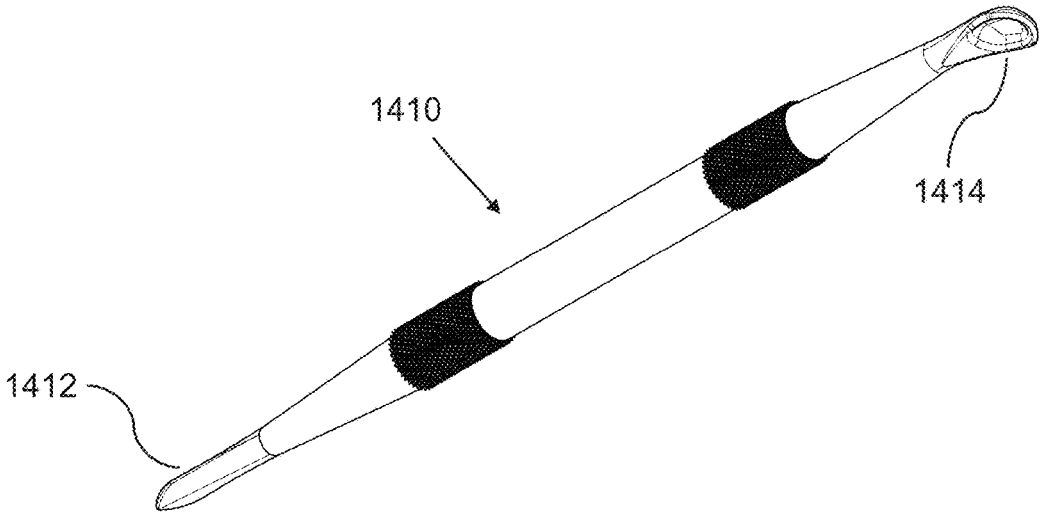
FIG. 14 is a perspective view of a vaping tool, according to an embodiment of the invention.
Figure 15A:
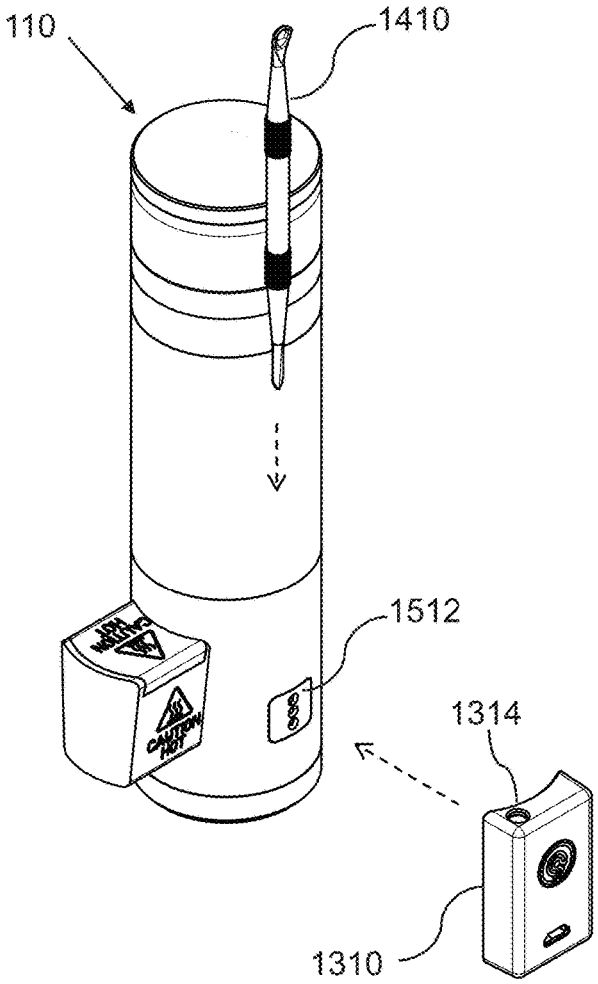
FIG. 15A is a perspective view illustrating the assembly of a vaping device, wireless charging module, and vaping tool, according to an embodiment of the invention.
Figure 15B:
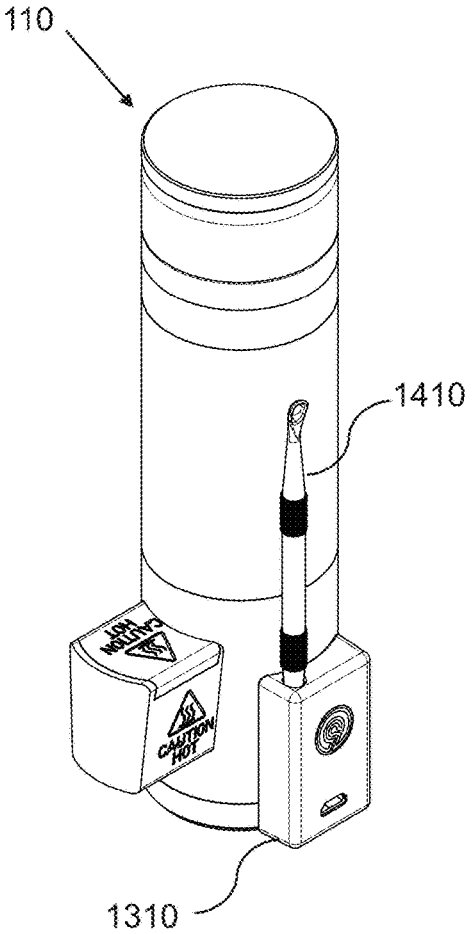
FIG. 15B is a perspective view of the assembly of a vaping device, wireless charging module, and vaping tool, according to an embodiment of the invention.

In a further related embodiment, as shown in FIGS. 11A and 12A, the vaporization module 125 and the device body 112 can be configured with magnets 1116, 1117 to enable the vaporization module 125 to be secure in place in the active configuration.

Figure 2C:
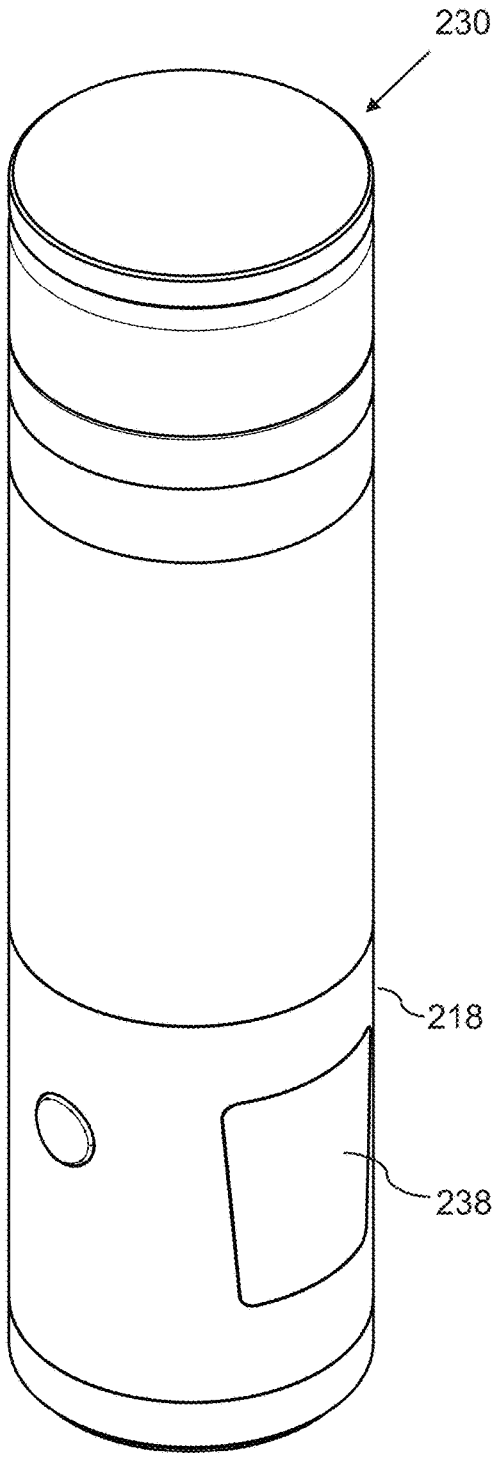
FIG. 2C is a top perspective view of a vaping system with an herb vaping assembly, which is fully inserted into a body of the vaping device in a stored configuration, according to an embodiment of the invention.
Figure 2D:
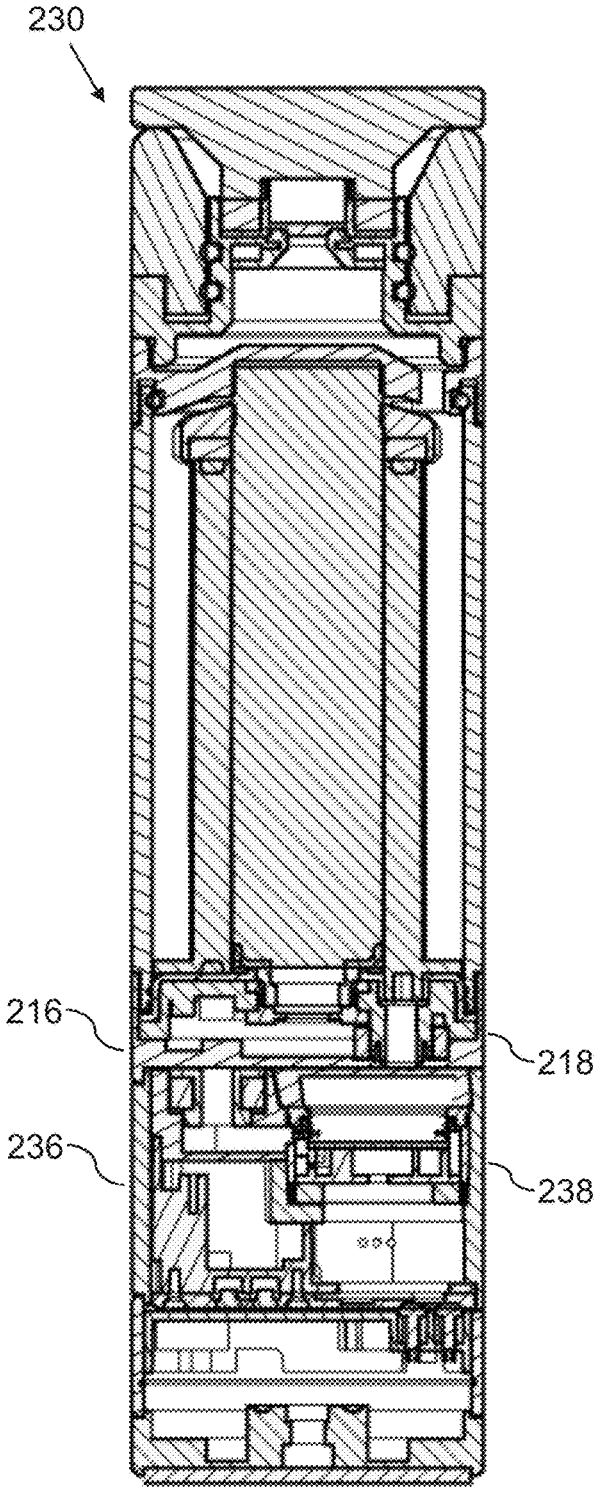
FIG. 2D is a cross-sectional view of a vaping system with an herb vaping assembly, which is fully inserted into a body of the vaping device in a stored configuration, according to an embodiment of the invention.

In a yet further related embodiment, as shown in FIGS. 2C and 2D, the vaporization module 125 can be configured to be fully insertable into the protruding cavity 118, which protrudes horizontally fully through the device body, such that an outer surface 236 of the inner portion of the vaporization module 125 is flush with a first side surface 216 of the device body 112, and such that an outer surface 238 of the outer portion of the vaporization module 125 is flush with an opposing second side surface 218 of the device body 112, such that the upper opening 326 to the vaporization chamber 422 is inside the device body 112, such that the vaping device 110 is in a stored configuration.

In another related embodiment, as shown in FIGS. 13A, 13B, 14, and 15A-15B, the vaping system 100 can further include:

a) a wireless charging module 1310, which can be configured to attach to a device body 112 of the vaping device 110, for example with magnets, such that electrical contacts 1312 of the wireless charging module 1310 connect with electrical contacts 1512 of the device body, such that the wireless charging module 1310 is configured to enable wireless charging. The wireless charging module 1310 can further include a charging port 1316, such as a USB port; and b) a vaping tool 1410, which can include an oil dapping portion 1412 and an herb scoop portion 1414, wherein the vaping tool 1410 can be configured to be storable in a tool aperture 1314 of the wireless charging module 1310.

In a further related embodiment, as shown in FIGS. 11A, 11B, and 16, the vaporization module 125 can further include:

a) a preheating chamber 1112, which is positioned in proximity to the vaporization chamber 422, such that the preheating chamber 1112 is in fluid contact with the vaporization chamber 422;

wherein the device body 112 comprises at least one air intake aperture 710, which is in fluid contact with the preheating chamber 1112, such that ambient air enters via the at least one air intake aperture 710, such that the ambient air 1612 is preheated in the preheating chamber 1112 before entering the vaporization chamber 422.

In a further related embodiment, as shown in FIGS. 1, 16, and 17, the vaping device 110 can further include:

a) a heating selector 115, which is configured to select a temperature setting for the heating element, such that the vaporization chamber 422 is heated to a temperature corresponding to the temperature setting;

b) a color light assembly 635, which can be an assembly of light emitting diodes 1636, wherein each light emitting diode 1636 emits a predetermined color of light 1638, such that the color light assembly 635 is configured to emit a plurality of predetermined colors of light 1638;

such that a light color 1638 emitted from the color light assembly 635 is configured to vary according to the selected temperature setting.

In a further related embodiment, the heating selector 115 can be configured as a ring which encircles the device body 112, such that rotation of the ring changes a temperature setting for the vaporization chamber 422 and correspondingly changes a color of light emitted from the color light assembly.

In a related embodiment, the vaping device 110 can be configured as a direct burn inhalation device, and the substance 1624 can be dried herb 1624.

In a further related embodiment, as shown in FIGS. 7A-7C, 11A, and 11B, the vaporization module 125 can be configured as an herb vaporization module 130, such that the vaporization chamber 422 is configured for heating/burning an herb material 1624, such as grounded cannabis flower or tobacco. The vaporization chamber 422 can be configured with a shallow interior, with straight walls and a flat bottom surface, such that a diameter of the vaporization chamber 422 is larger than a depth of the vaporization chamber 422.

In a further related embodiment, as shown in FIGS. 7A-7C, the herb vaporization module 130, can further include a top cover 134, which is configured to detachably cover an opening of the vaporization chamber 422. The top cover 134 can be securable in place with magnets 734.

In a further related embodiment, as shown in FIGS. 8A-8B, 12A, and 12B, the vaporization module 125 can be configured as an oil vaporization module 140, such that the vaporization chamber 422 is configured for vaporizing an oil or wax 1724, such as THC or CBD oil. The vaporization chamber 422 can be configured with an elongated interior, which can narrow from a top aperture to a bottom of the vaporization chamber 422, such that an upper diameter of the vaporization chamber 422 is smaller than a depth of the vaporization chamber 422.

In another related embodiment, the vaping device 110 can be configured as a vaporizing inhalation device, and the substance can be oil, wax or ointment.

In yet a related embodiment, the vaping device 110 can include an air duct configured to enable air to enter the vaporization chamber and to assist in the burning of the substance.

In yet a related embodiment, as shown in FIGS. 16 and 17, the vaping device 110 can include a heating element 1015, which is positioned in or adjacent to the vaporization chamber 422, such that the heating element is configured to heat the vaporization chamber 422. The heating element 1015 can be configured as a flat coil 1015, which can be positioned adjacent to and directly below a flat bottom surface of the vaporization chamber 422.

In the present embodiment, heating element may be made of metal as metal typically provides effective heat conductivity. It is contemplated that a variety of other heat conducting materials may be used in some alternate embodiments including, without limitation, ceramic materials, porcelain, some natural stone, etc.

In the present embodiment, the heating element may be connected to a heat source such as, but not limited to, a battery 624, by which heat may be transferred to the heating element so that the heating element may be heated until glowing red to typically enable combustion of the substance within vaporization chamber 422.

Alternate embodiments may use various different means for heating the heating element such as, but not limited to, heating coils within the base and heating rod or by forming a heating coil into the shape of a flat base and vertically extending rod. Another contemplated embodiment includes but not limited to ball shape 360-degree heating via coils inside the heating element.

It is contemplated that a multiplicity of suitable designs may be used for the heating element to provide heat throughout the substance being burned other than a flat base and vertical rod. For example, without limitation, in some embodiments, the heating element may comprise a cone shape or a flat base with multiple vertical rods. Other embodiments may implement heating elements that provide heat from the bottom, middle, and also the top of the vaporization chamber. Yet other embodiments may comprise heating elements that provide heat from the bottom and/or the top of the burning compartment as well as around the outside surface of the vaporization chamber. These embodiments may or may not comprise one or more heating rods through the middle of the vaporization chamber. In one such embodiment the vaporization chamber may be implemented as a sphere in which the entire surface area may conduct heat to the substance being burned. Another embodiment could be of a circular ball shape compartment which the substance inside are receiving heat from all directions. What is to be considered is the structure of the material being vaporized or burned. If the substance is in liquid format, then perhaps it requires an enclosed compartment. Or if the substance consists of solid form which air holes would need to be designed in the burning compartment to allow for air flow.

During the inhalation process of any vaporizer or direct burning device, a user typically takes breaks between each inhalation. Current devices may not include means to trap the vapor or smoke after burning or vaporization and some vapor or smoke may escape during the process, particularly between inhalations. An aspect of the present embodiment is to trap the vapor or smoke in a sealed chamber 1118 to help eliminate waste. Some alternate embodiments may also comprise a valve near the mouthpiece to trap the smoke or vapor in the sealed chamber 1118 above the vaporizing or burning chamber that may remain between inhalations.

In the present embodiment, the vaporizing device 110 may comprise a water chamber 120 through which smoke or vapor may be filtered before inhalation. In an alternative embodiment, the smoke or vapor may be unfiltered. In the present embodiment, a one-way valve near the bottom of the water chamber 120 may help ensure that water does not escape through the bottom of water chamber 120 while still enabling smoke or vapor to pass from the vaporization chamber 422 to the water chamber 120 when a user is inhaling.

The one-way valve may enable the smoke or vapor to enter the water chamber 120 and substantially prevents the contents of the water chamber 120 from coming back down into the vaporization chamber 422.

Those skilled in the art will readily recognize, in light of and in accordance with the teachings of the present invention that a multiplicity of suitable alternate and additional features may be provided in some embodiments. For example, without limitation, some embodiments may comprise magnetic interchangeable chambers that may enable the inhalation device to be converted for different types of materials and substances or burning methods such as, but not limited to, dry herb direct burning, dry herb vaporization, heating or burning of wax in various forms, oil vaporization, ointment vaporization, etc. Some of these embodiments may comprise means for automatically detecting which chamber is installed to help determine the proper burning temperature. In some embodiments, the chamber may be configured to provide a metered inhalation device. Some embodiments may comprise a built-in grinder and dry herb storage area so that dry herbs may be stored in the device in larger pieces and, when needed, ground into smaller more easily burned pieces.

The vaporizing device 110 may include an airflow chamber 418, a water chamber (an outer transparent cylindrical cover) 120 encircling the airflow chamber 418, a lower portion 119 including a vaporization chamber 422, and a mouthpiece 124. The air flow chamber 418 may include water entry/filtered air exit port 438.

The air flow chamber may include two concentric tubes 542 and 544. The inner tube 542 may include the battery 624 to supply power to the vaporizing device 110.

The air flow chamber 418 may be divided into a plurality of compartments. In one exemplary embodiment, the air flow chamber 418 may be divided into six compartments using six dividers of which three dividers 546, 548, and 550 are shown in FIG. 5D laid out between an outer surface of the inside tube 542 and an inner surface of outside tube 544. In one embodiment, the concentric tubes 542 and 544 and the dividers may form an integral structure forming the air flow chamber 418. The design and layout of the dividers are provided in FIG. 5D. Assuming that the inner cylinder is cut open along its length and laid out with the dividers 546, 548, 550, 552, 554, and 556 facing upwards, the dividers 548, 552, and 554 may be disposed such that the dividers touch the top edge 564 of the air flow chamber 418; the dividers 550, 546, and 556 may be disposed such that the dividers touch the lower edge 562 of the air flow chamber 418. The dividers may connect the inner surface of the outer tube and seals the outer surface of the inner tube with a water and air tight silicon seal. In one embodiment, the dividers are so lay out that they form a non-linear tunnel for the path of airflow 572 through the air flow chamber 418.

During a typical working of the vaporizing device 110, external air may enter through the vaporization module 125. The air (mixed with the vapors of the herb or other material placed in the vaporization chamber 422) may then pass downward through the vaporization chamber 422, and the air may leave the vaporization chamber 422 pass upward through the one-way valve into the air flow chamber 418 through the air flow vent 536 that connects the tube one-way valve and the air flow chamber 418. The air follows the path 572 as shown in FIG. 5D and may travel through the gaps between the dividers. Referring to FIG. 5D, the air follows the path 572 between the dividers 548, 546, 554, 556, 552, and 550 before exiting through filtered air exit port 438. i.e., air may have to travel three times up and three times down between the compartments before reaching the water 482 and exiting from the filtered air exit port 438.

Water 482 for filtration may be provided in the space between the water chamber 120 and the air flow chamber 418. The water 482 may enter the air flow chamber 418 through the water entry port 438 and may fill the space between dividers 550 and 548. As mentioned above the divider 548 is connected both to the top edge and the bottom edge of the air flow chamber 418. Accordingly, the air follows a path as described herein 572 above and the water follows path 574 and fills the space between dividers 548 and 550. It may be appreciated by a person with ordinary skill in the art, in light of and in accordance with the teachings of the present invention, that the amount of water 482 used for filtration may be such that it may be sufficient to enter through the water entry port 438 raise to a height to fill the space between the dividers 548 and 550 but not sufficient enough to follow the path and flow over and fill the gaps between dividers 550 and 552, i.e., not sufficient enough to follow the opposite path of the flow of air and reach the air entry port 536. Accordingly, in one embodiment, the flow of water used for filtration may be contained in the device 110 in a manner such that it may not leak out or spill into the vaporization chamber 422 through air entry port 536.

In the exemplary embodiment, shown in FIGS. 5C and 5D the air flow path 572 formed between the compartments in the air flow chamber 418 is open so that air and heated gas may flow up and down freely during inhalation.

It may be appreciated by a person with ordinary skill in the art, in light of and in accordance with the teachings of the present invention that if the vaporizing device 110, were to be intentionally turned upside down multiple number of times, in the exemplary embodiment described herein at least six times, it may be possible that a very small amount of water 482 may escape into the space between the rest of the dividers i.e., the dividers 550, 552, 556, 554, 546, and 548 and reach the air entry port 536. It may be appreciated by a person with ordinary skill in the art, in light of and in accordance with the teachings of the present invention that water 482 may leak or follow the path opposite to air only if the vaporizing device 110 may be accidentally or intentionally mishandled. i.e., for the water 482 to leak into vaporization chamber 422, the water 482 may need to travel up and down through the air flow path 572 in a direction opposite to the air flow path 572 through compartments multiple times. Since gravity may act to impel the water 482 to move in a downward direction, the water flow in a direction opposite to air flow may occur only if a user shakes the vaporizing 110 up and down or turns inhalation device upside down and then right side up multiple times. A user may not engage in such an activity during normal usage/working of the vaporizing device 110. Even if a user shakes or rotates the vaporizing device 110 up and down, the amount of water 482 that may travel through all the tunnels of air flow chamber 418 and reach the vaporization chamber 422 may be negligible. In certain instances, water may leak into the vaporization chamber 422 if a user may blow into the mouthpiece 124 instead of inhaling from the mouthpiece 124, which may not be considered as a normal usage of the vaporizing device 110.

In certain embodiments, the water chamber 120 containing the water 482 and the vaporization chamber 422 may be separate pieces that are fixed together. In the present embodiment, combustion or vaporization chamber 422 may be electronically heated to produce a heated gas from a substance being burned or vaporized in the vaporization chamber 422.

The mouthpiece 124 on top of air flow chamber 418 may seal and connect the upper edge 564 of the air flow chamber 418, thus forming the air flow path/passage 572 that allows the air to enter at air entry port 536 and move in a non-linear manner between channels formed between the dividers, before coming into contact with water 482 for filtration and exiting from the filtered air exit port 438.

It may be appreciated by a person with ordinary skill in the art, in light of and in accordance with the teachings of the present invention that the tunnels of the air passage in some alternate embodiments may implement different configurations that may minimize leakage, such as, but not limited to, spiral configurations, zigzag configurations, and stepped configurations.

Accordingly, in typical use of the vaporizing device 110, in one embodiment, a user may inhale through the mouthpiece 124. Air may flow into the vaporization chamber 422. The air is mixed with heated gas from the substance being heated in the vaporization chamber 422. A gas mixture comprising the air and heated gas may then enter the air flow chamber 418 through port 536 as described hereinabove. The air may then follow path 572 and travel through the compartments to port 438. The gas mixture may escape through the exit port 438 into the water 482 near the bottom of the water chamber 120 and travels through the water 482 for filtration. Then a user may inhale the gas mixture through mouthpiece 124.

Figure 6A:
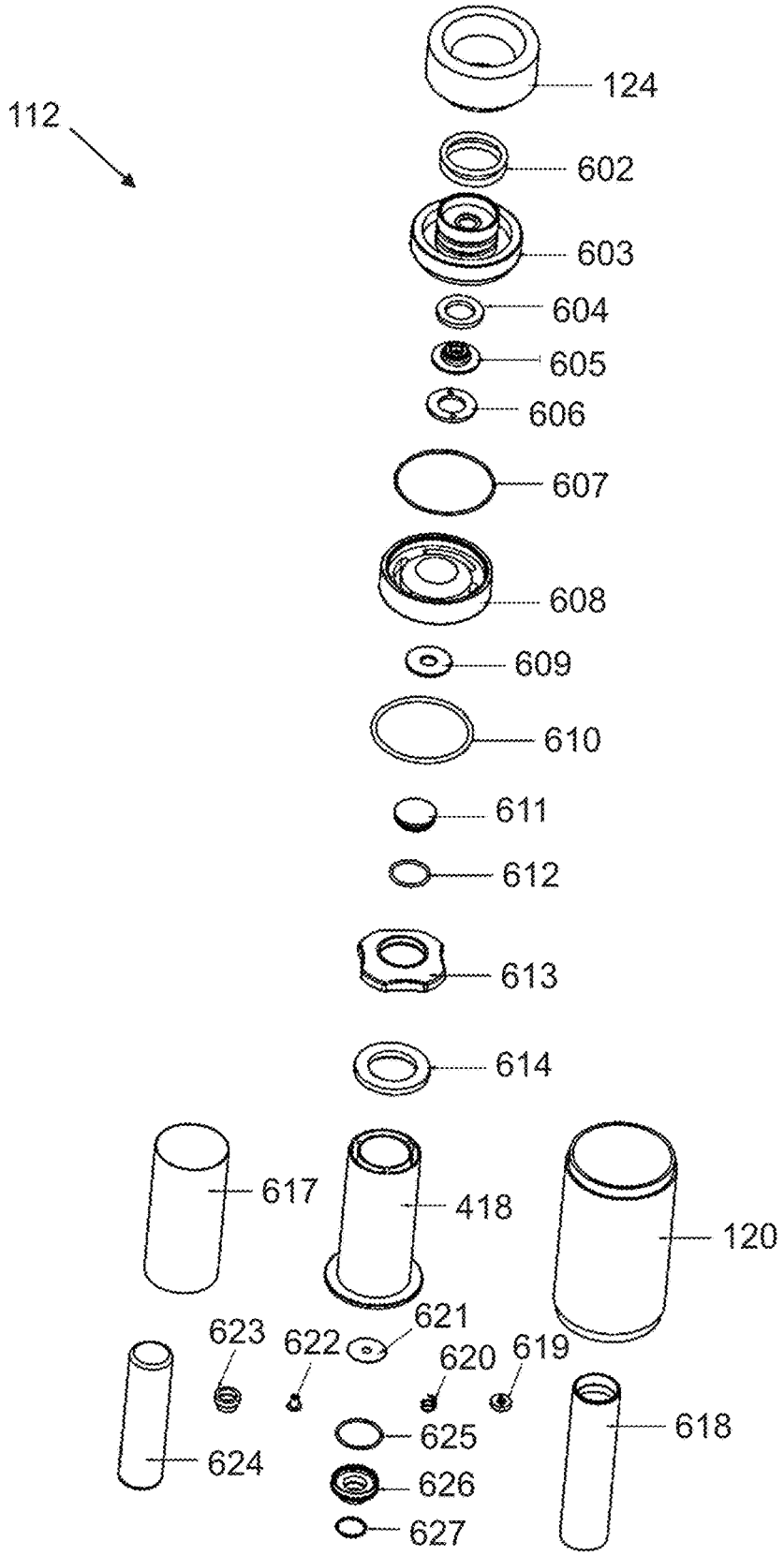
FIG. 6A is a perspective view of an exploded assembly of the upper half of a vaping device body, according to an embodiment of the invention.
Figure 6B:
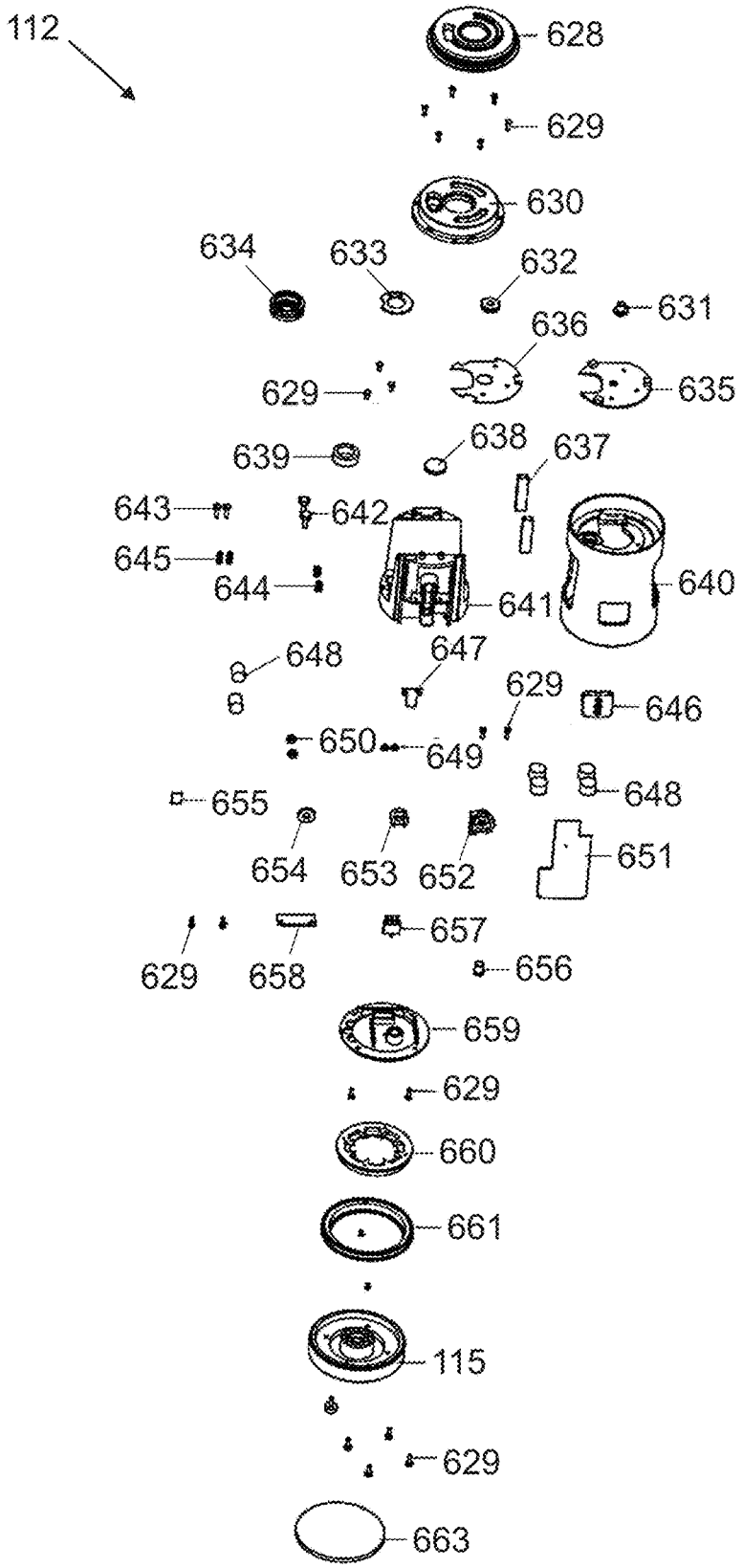
FIG. 6B is a perspective view of an exploded assembly of the lower half of a vaping device body, according to an embodiment of the invention.

In an embodiment, as shown in FIGS. 6A and 6B, the vaping device body 112 can include:

a. A glass mouthpiece 124;
b. An O-ring silicone 602;
c. An upper tube 603;
d. An upper tube magnet 604;
e. An upper tube silicone 605;
f. An upper tube magnet situating ring 606;
g. An o-ring silicone 607;
h. A middle tube 608;
i. A middle tube anti-liquid silicone 609;
j. An o-ring silicone 610;
k. A battery case head 611;
l. An o-ring silicone 612;
m. A battery case upper cover 613;
n. An anti-liquid silicone 614;
o. A water chamber 120;
p. An air flow chamber 418;
q. An air path tube outer shell 617;
r. A battery compartment 618;
s. A battery compartment cover 619;
t. A spring 620;
u. A battery compartment PVC piece 621;
v. A battery compartment electrical conductor 622;
w. A battery compartment stationing backbone 623;
x. A battery 18650 624;
y. An o-ring silicone 625;
z. A battery compartment base 626;
aa. An o-ring silicone 627;
bb. A bottom silicone 628;
cc. 8 screws 629;
dd. A base 630;
ee. A battery compartment conduction pin 631;
ff. A conduction pin silicone ring 632;
gg. A conduction copper base unit 633;
hh. A conduction base unit 634;
ii. A PCB with color light assembly 635;
jj. A PCV base 636;
kk. a magnet 637;
ll. a silicone piece 638;
mm. an airpath magnet 639;
nn. a bottom tube 640;
oo. a plastic body 641;
pp. a first main body conduction 642;
qq. a second main body conduction 643;
rr. a first conduction spring 644;
ss. a second conduction spring 645;
tt. a charging port 646;
uu. a main body charging PCB 647;
vv. main body charging magnets 648;
ww. conduction screw females 649;
xx. a V shape cover 650;
yy. a main PCB 651;
zz. a plastic button 652;
aaa. a silicone button 653;
bbb. a circular PVC piece 654;
ccc. a rectangular PVC piece 655;
ddd. a rotation circular stopper plug 656;
eee. a left and right restationing ON/OFF switch 657;
fff. a PCB for knob 658;
ggg. a plastic body cover 659;
hhh. a heat adjustment backbone 660;
iii. a ring for stationing 661;
jjj. a heating selector ring 115 (also called a heating selector bottom cap 115); and
kkk. a bottom cover 663.

Figure 9:
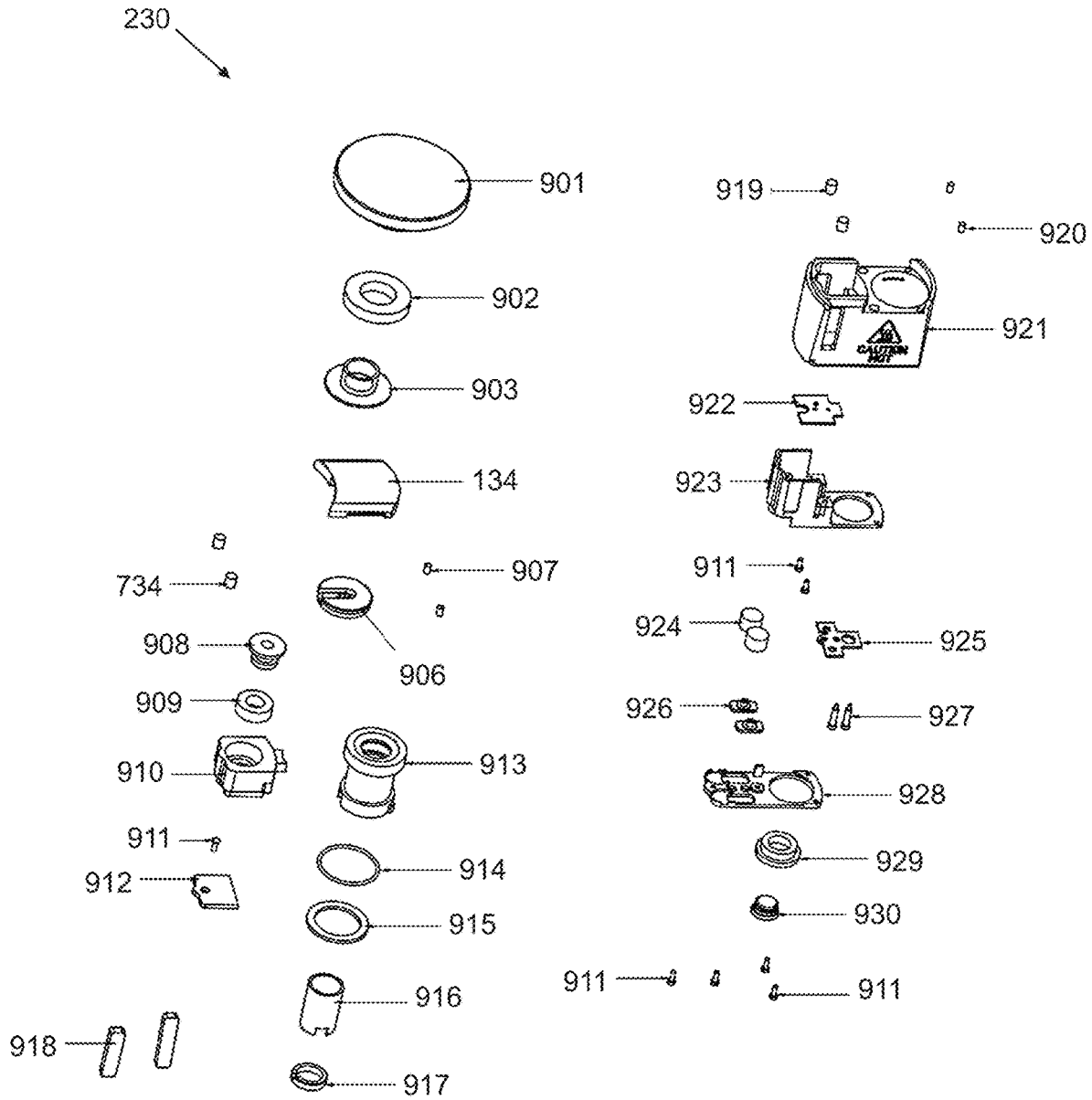
FIG. 9 is a perspective view of an exploded assembly of an herb vaping assembly, according to an embodiment of the invention.

In an embodiment, as shown in FIG. 9, the herb vaporization module 130 can further include:

a. A vaporizer mouthpiece cover 901;
b. A cup shape magnet 902;
c. A magnet situating ring 903;
d. A vaporizer slidable chamber top cover 134;
e. A top cover magnet 734;
f. A top cover airpath silicone 906;
g. A top magnet 907;
h. A first airpath silicone 908;
i. A cup shape magnet 909;
j. A second airpath silicone 910;
k. 4 screws 911;
l. A plastic cover 912;
m. A ceramic chamber base 913;
n. An o-ring silicone 914;
o. A silicone cover 915;
p. A ceramic chamber 916;
q. A ceramic chamber stationing ring 917;
r. A square magnet 918;
s. A first slidable chamber magnet 919;
t. A second slidable chamber magnet 920;
u. A vaporizing chamber 921;
v. A first PCB board 922;

w. A slidable chamber plastic body 923;
x. A magnet 924;
y. A second PCB board 925;
z. A first conduction 926;
aa. A second conduction 927;
bb. A slidable chamber cover 928;
cc. A ceramic chamber stationing base 929; and
dd. ceramic chamber parts 930.

Figure 10:
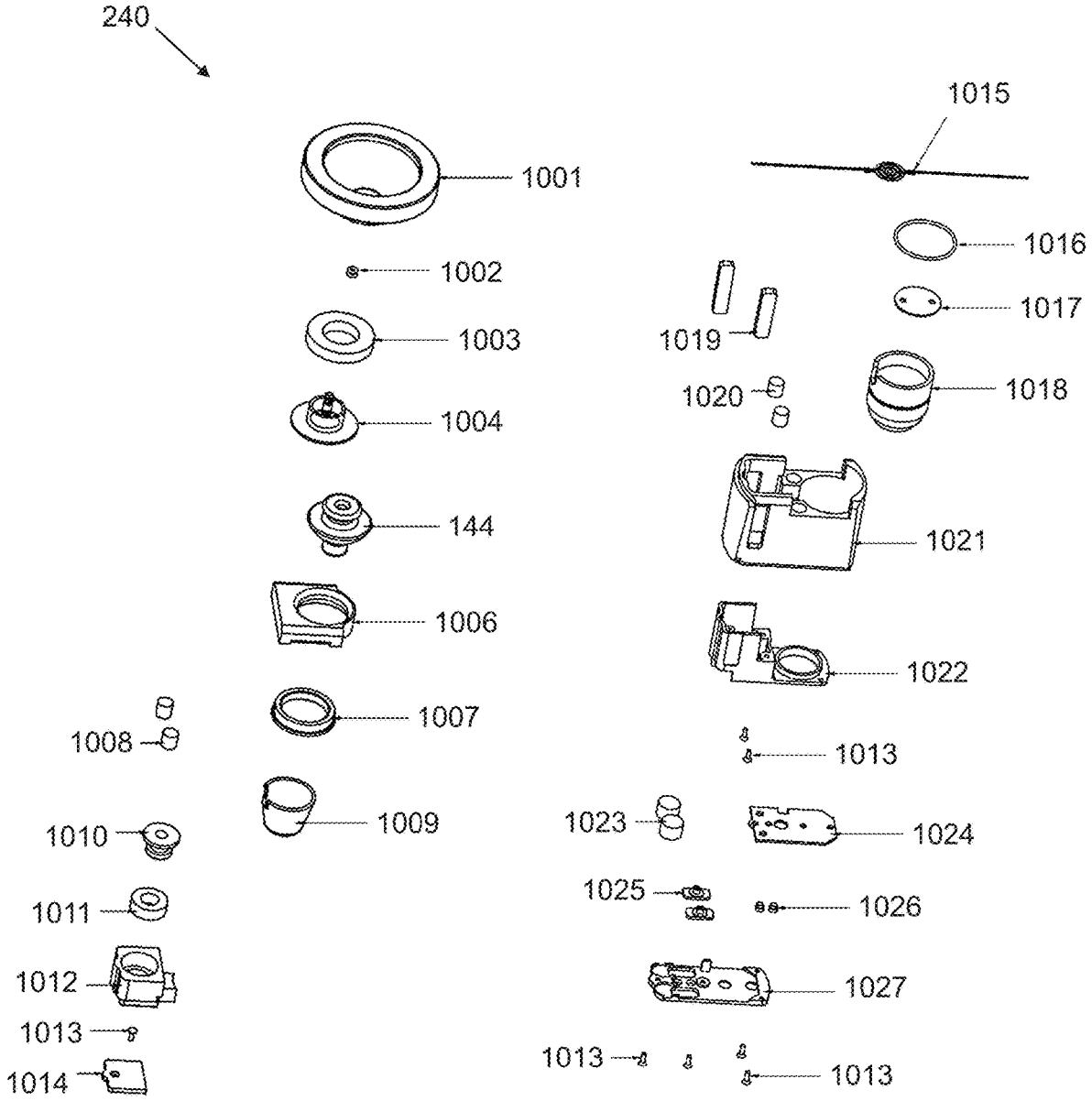
FIG. 10 is a perspective view of an exploded assembly of an oil vaping assembly, according to an embodiment of the invention.

In an embodiment, as shown in FIG. 10, the oil vaporization module 140 can further include:

a. An exist airpath cover 1001;
b. An o-ring 1002;
c. A cup shape magnet 1003;
d. A magnet situating ring 1004;
e. An airpath glass cover 144, also called a carb cap 144;
f. A slidable chamber top cover 1006;
g. A glass cup situating cup 1007;
h. A top magnet 1008;
i. A quartz cup 1009;
j. A first airpath silicone 1010;
k. An airpath magnet 1011;
l. A second airpath silicone 1012;
m. 4 screws 1013;
n. A plastic cover board 1014;
o. A heating coil 1015;
p. An o-ring 1016;
q. A first heat shielding 1017;
r. A second heat shielding 1018;
s. A square magnet 1019;
t. A sliding magnet 1020;
u. A slidable chamber 1021;
v. A slidable chamber plastic body 1022;
w. A magnet 1023;
x. A PCB 1024;
y. A first conduction 1025;
z. A second conduction 1026; and
aa. A slidable chamber bottom cover 1027.

Here has thus been described a multitude of embodiments of the vaping system 100, the vaping device 110, and methods related thereto, which can be employed in numerous modes of usage.

The many features and advantages of the invention are apparent from the detailed specification, and thus, it is intended by the appended claims to cover all such features and advantages of the invention, which fall within the true spirit and scope of the invention.

By way of example, and not limitation, the means for heat distribution described in the foregoing were principally directed to inhalation device implementations; however, similar techniques may instead be applied to potpourri or wax warmers used to provide fragrance, humidifiers, or medical vaporizers, which implementations of the present invention are contemplated as within the scope of the present invention.

Many such alternative configurations are readily apparent, and should be considered fully included in this specification and the claims appended hereto. Accordingly, since numerous modifications and variations will readily occur to those skilled in the art, the invention is not limited to the exact construction and operation illustrated and described, and thus, all suitable modifications and equivalents may be resorted to, falling within the scope of the invention.

What is claimed is:

1. A vaping device comprising:
a device body; and
a vaporization module, which comprises:
a module body, which comprises:
an upper opening; and
a vaporization chamber, wherein the vaporization chamber is configured to be substantially enclosed during operation and operable for containing a substance for vaporization;
such that the upper opening provides access to the vaporization chamber;
wherein the vaporization module is configured to be detachably mountable to the device body;
wherein the device body further comprises:
a protruding cavity, which protrudes into the device body;
such that the vaporization module is configured to be partially insertable into the protruding cavity, such that an inner portion of the vaporization module is inserted into the protruding cavity, and such that an outer portion of the vaporization module protrudes to a side of the device body, such that the upper opening to the vaporization chamber is exposed, such that the vaping device is in an active configuration for vaping use.

2. The vaping device of claim 1, further comprising:
an air flow chamber, which is connected to the vaporization chamber, wherein the air flow chamber is configured to provide a tunnel between an upper edge and a lower edge of the air flow chamber, for passage of air/vapor from an air/vapor entry port to a filtered air exit port; and
a mouthpiece for inhaling smoke or vapor;
wherein the mouthpiece is placed on a top of the vaping device, wherein the mouthpiece is configured to seal and connect the upper edge of the air flow chamber to form an air flow passage.

3. The vaping device of claim 2, wherein the air flow passage comprises spiral, zigzag, or stepped configuration.

4. The vaping device of claim 1, wherein the vaporization module is configured to be fully insertable into the protruding cavity, which protrudes through the device body, such that an outer surface of the inner portion of the vaporization module is flush with a first side surface of the module body, and such that an outer surface of the outer portion of the vaporization module is flush with an opposing second side surface of the device body, such that the upper opening to the vaporization chamber is inside the device body, such that the vaping device is in a stored configuration.

5. The vaping device of claim 1, wherein the vaporization module further comprises:
a preheating chamber, which is positioned in proximity to the vaporization chamber, such that the preheating chamber is in fluid contact with the vaporization chamber;
wherein the device body comprises at least one air intake aperture, which is in fluid contact with the preheating chamber, such that ambient air enters via the at least one air intake aperture, such that the ambient air is preheated in the preheating chamber before entering the vaporization chamber.

6. The vaping device of claim 1, wherein the vaporization module is configured as an herb vaporization module, such that the vaporization chamber is configured for heating an herb material, wherein the substance is the herb material.

7. The vaping device of claim 6, wherein the vaporization chamber is configured with a shallow interior with a flat bottom surface, such that a diameter of the vaporization chamber is larger than a depth of the vaporization chamber.

8. The vaping device of claim 1, wherein the vaporization module is configured as an oil vaporization module, such that the vaporization chamber is configured for vaporizing an oil or wax, wherein the substance is the oil or wax.

9. The vaping device of claim 8, wherein the vaporization chamber is configured with an elongated interior, which narrows from a top aperture to a bottom of the vaporization chamber, such that an upper diameter of the vaporization chamber is smaller than a depth of the vaporization chamber.

10. The vaping device of claim 1, further comprising a heating element, which is positioned in or adjacent to the vaporization chamber, such that the heating element is configured to heat the vaporization chamber.

11. The vaping device of claim 10, wherein the heating element is configured as a flat coil, which is positioned below a flat bottom surface of the vaporization chamber.

12. The vaping device of claim 10, further comprising:

a) a heating selector, which is configured to select a temperature setting for the heating element, such that the vaporization chamber is heated to a temperature corresponding to the temperature setting; and b) a color light assembly, which is configured to emit a plurality of predetermined colors of light;

such that a light color emitted from the color light assembly is configured to vary according to the temperature setting.

13. The vaping device of claim 12, further comprising a device body, wherein the heating selector is configured as a ring which encircles the device body, such that rotation of the ring changes a temperature setting for the vaporization chamber and correspondingly changes a color of light emitted from the color light assembly.

14. The vaping device of claim 1, further comprising:

a) a water chamber, wherein the water chamber is connected to the vaporization chamber; and b) an air flow chamber, wherein the air flow chamber is connected between the vaporization chamber and the water chamber, wherein the air flow chamber is configured to provide a tunnel between an upper edge and a lower edge of the air flow chamber, for passage of air/vapor from an air/vapor entry port to a filtered air exit port for air/vapor at the water chamber, in a non-linear manner; wherein the air flow chamber is configured to prevent leakage of water from the water chamber to the vaporization chamber.

15. A vaping device comprising:

a) a device body; and b) a vaporization module, which comprises:

a module body, which comprises an upper opening and a vaporization chamber, such that the upper opening provides access to the vaporization chamber;

wherein the vaporization chamber is configured to be operable for containing a substance for vaporization;

wherein the device body further comprises:

a protruding cavity, which protrudes into the device body;

such that the vaporization module is configured to be partially insertable into the protruding cavity, such that an inner portion of the vaporization module is inserted into the protruding cavity, and such that an outer portion of the vaporization module protrudes to a side of the device body, such that the upper opening to the vaporization chamber is exposed, such that the vaping device is in an active configuration for vaping use;

wherein the vaporization module is configured to be detachably mountable to the device body.

16. The vaping device of claim 15, wherein the vaporization module is configured to be fully insertable into the protruding cavity, which protrudes through the device body, such that an outer surface of the inner portion of the vaporization module is flush with a first side surface of the module body, and such that an outer surface of the outer portion of the vaporization module is flush with an opposing second side surface of the device body, such that the upper opening to the vaporization chamber is inside the device body, such that the vaping device is in a stored configuration.

17. A vaping system comprising:

a) a device body; and b) a plurality of vaporization modules, which each comprise:

a module body, which comprises an upper opening and a vaporization chamber, such that the upper opening provides access to the vaporization chamber;

wherein the vaporization chamber is configured to be operable for containing a substance for vaporization;

wherein each corresponding vaporization module in the plurality of vaporization modules is configured to be detachably mountable to the device body;

wherein the device body further comprises:

a protruding cavity, which protrudes into the device body;

such that the corresponding vaporization module is configured to be partially insertable into the protruding cavity, such that an inner portion of the corresponding vaporization module is insertable into the protruding cavity, such that an outer portion of the vaporization module protrudes to a side of the device body, such that the upper opening to the vaporization chamber is exposed, such that the vaping device is in an active configuration for vaping use.

18. The vaping system of claim 17, wherein the plurality of vaporization modules comprises:

a) an herb vaporization module, such that the vaporization chamber of the herb vaporization module is configured for heating an herb material; and b) an oil vaporization module, such that the vaporization chamber of the oil vaporization module is configured for vaporizing an oil or wax.

* * * * *